US012379169B2

(12) United States Patent
Parker

(10) Patent No.: US 12,379,169 B2
(45) Date of Patent: Aug. 5, 2025

(54) SIDE CHARGING HANDLE FOR SEMI-AUTOMATIC FIREARM

(71) Applicant: Sturm, Ruger & Company, Inc., Southport, CT (US)

(72) Inventor: Benjamin Keyes Parker, Stokesdale, NC (US)

(73) Assignee: Sturm, Ruger & Company, Inc.

( * ) Notice: Subject to any disclaimer, the term of this patent is extended or adjusted under 35 U.S.C. 154(b) by 0 days.

(21) Appl. No.: 18/598,927

(22) Filed: Mar. 7, 2024

(65) Prior Publication Data

US 2024/0318933 A1 Sep. 26, 2024

Related U.S. Application Data

(60) Provisional application No. 63/491,325, filed on Mar. 21, 2023.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06
See application file for complete search history.

(56) References Cited

U.S. PATENT DOCUMENTS 3,653,140 A * 4/1972 Alday ..... F41A 3/20 42/16
4,930,239 A 6/1990 Hunter
4,967,642 A * 11/1990 Mihaita ..... F41C 23/04 D22/104
5,259,137 A * 11/1993 Blenk ..... F41A 3/42 42/16
7,849,777 B1 12/2010 Zedrosser
8,266,998 B1 9/2012 Davis
8,307,747 B2 11/2012 Fitzpatrick et al.
8,333,137 B2 12/2012 Sirochman
8,342,075 B2 1/2013 Gomez
8,407,925 B2 4/2013 Fesas
8,539,871 B1 9/2013 Burt et al.
(Continued)

OTHER PUBLICATIONS

International Search Report and Written Opinion of PCT/US2024/18940, Issued Aug. 15, 2024.

*Primary Examiner* — Joshua E Freeman
(74) *Attorney, Agent, or Firm* — The Belles Group, P.C.

(57) ABSTRACT

A firearm with side-mounted charging handle includes a longitudinal axis, a receiver, a barrel, and a bolt carrier assembly movably disposed in the receiver. The bolt carrier assembly includes a bolt carrier and a bolt disposed at least partially therein. A charging handle comprises a mounting pin member passing transversely through the bolt carrier between first and second lateral sides thereof, and a grasping member projecting transversely outwards from the first lateral side of the bolt carrier for manually cycling the bolt carrier assembly from a forward closed breech position to the rearward open breech position. A firing pin is disposed in bolt for axial movement to strike a chambered cartridge to discharge the firearm. The charging handle mounting pin member is configured to cooperate with and retain the firing pin in the bolt carrier to block withdrawal of the firing pin from the bolt carrier assembly.

20 Claims, 25 Drawing Sheets

(56) References Cited

U.S. PATENT DOCUMENTS

| | | | | |
|---|---|---|---|---|
| 8,567,301 | B1 | 10/2013 | Sharron | |
| 8,661,963 | B2 | 3/2014 | Patel | |
| 8,800,422 | B2 * | 8/2014 | Norton | F41A 15/14 89/185 |
| 8,997,620 | B2 | 4/2015 | Brown | |
| 9,109,848 | B2 | 8/2015 | Brown | |
| 9,310,146 | B2 * | 4/2016 | Gibbens | F41C 23/16 |
| 9,341,420 | B2 | 5/2016 | Foster | |
| 9,377,255 | B2 | 6/2016 | Karagias | |
| 9,879,929 | B2 | 1/2018 | Leimer | |
| 9,897,406 | B2 | 2/2018 | Oz et al. | |
| 9,958,229 | B1 | 5/2018 | Meier | |
| D819,766 | S | 6/2018 | Farris et al. | |
| 10,215,513 | B2 * | 2/2019 | Cross | F41A 19/25 |
| 10,267,580 | B2 | 4/2019 | Wheatley | |
| 10,345,059 | B2 * | 7/2019 | Gibbens | F41A 3/66 |
| 10,352,635 | B2 | 7/2019 | Noonan | |
| 10,458,731 | B2 * | 10/2019 | Mather | F41A 3/22 |
| 10,527,372 | B2 * | 1/2020 | Brown | F41A 3/16 |
| 10,533,815 | B1 | 1/2020 | Chang et al. | |
| 10,598,451 | B1 | 3/2020 | Haidu | |
| 10,697,722 | B2 | 6/2020 | Kling et al. | |
| 11,041,683 | B2 | 6/2021 | Lowe | |
| 11,473,863 | B2 | 10/2022 | Knopfle | |
| 11,519,690 | B2 | 12/2022 | Aldstadt | |
| D996,556 | S * | 8/2023 | Rathbone | D22/199 |
| 2011/0061523 | A1 | 3/2011 | Webb | |
| 2014/0013641 | A1 * | 1/2014 | Warburton | F41A 3/22 42/16 |
| 2014/0059910 | A1 * | 3/2014 | Norton | F41A 3/72 42/9 |
| 2015/0233656 | A1 * | 8/2015 | Karagias | F41A 3/14 42/16 |
| 2017/0176119 | A1 | 6/2017 | Cross | |
| 2017/0191773 | A1 * | 7/2017 | Oz | F41A 3/72 |
| 2018/0195818 | A1 * | 7/2018 | Schafer | F41A 15/12 |
| 2019/0078849 | A1 * | 3/2019 | Schafer | F41A 3/22 |
| 2020/0263942 | A1 * | 8/2020 | Karagias | F41A 15/14 |
| 2021/0381784 | A1 * | 12/2021 | Alomaira | F41A 3/72 |
| 2022/0178632 | A1 | 6/2022 | Lee et al. | |
| 2022/0341692 | A1 * | 10/2022 | Markut | F41A 19/13 |

* cited by examiner

SIDE CHARGING HANDLE FOR SEMI-AUTOMATIC FIREARM

CROSS-REFERENCE TO RELATED APPLICATIONS

The present application claimed the benefit of priority to U.S. Provisional Application No. 63/491,325 filed Mar. 21, 2023, which is incorporated herein by reference in its entirety.

BACKGROUND

The present invention generally relates to semi-automatic firearms, and more particularly to a side-mounted charging handle for such firearms such as rifles or carbines which may be used to manually cycle the action.

Typically, a charging handle is used to "charge" or "cycle" (i.e. actuate) the action of an AR-type firearm such as a rifle or carbine. For example, conventional charging handles for such AR-type firearms generally comprise elongated rods which are mounted on top of the upper receiver. The rear ends of these hands are T-shaped and protrude rearwardly from the upper receiver for grasping and manual actuation by the user. The forward end of these type charging handles extends forward through a top portion of the receiver in order to locate and "grab" the bolt carrier group which comprises the bolt carrier which holds the bolt configured to form a locked breech. The "action" (bolt carrier group) may be manually withdrawn rearward or cycled to open the breech and provide access to the chamber at the rear of the barrel which holds an ammunition cartridge.

Such conventional T-shaped top and rear mounted charging handles for AR-type firearms may not be easy to grasp and can be cumbersome for some users to operate.

Improvements in charging handles for AR-type or other conventional firearms are desired which can also provide ambidextrous operation for both right and left handed users.

SUMMARY OF THE INVENTION

Embodiments of the present invention provide an improved side-mounted ambidextrous charging handle for a firearm, including without limitation an AR-type semi-automatic firearm. The firearm may be an AR-type long gun such as a rifle or carbine in some non-limiting examples; however, the present side-mounted charging handle may also be used for other type conventional long guns.

The side-mounted charging handle is mountable to either side of the bolt carrier assembly of the firearm via a commonly configured charging handle mounting interface provided on the right and left lateral sides of the bolt carrier. The bolt carrier assembly collectively includes the bolt carrier which supports a bolt therein configured to form a closed and locked breech. The bolt carrier assembly is manually retractable from a forward closed breech position to a rearward open breech position via the charging handle.

The charging handle may be coupled to the bolt carrier assembly via a transversely oriented mounting pin member of the charging handle and a self-retrained retention clip engageable therewith. The clip may be slideably mounted to one of the lateral sides of the bolt carrier and is movable between locked and unlocked positions, as further described herein. This prevents the retention clip from getting lost when the charging handle is dismounted from the bolt carrier assembly.

The charging handle is further configured to also retain the firing pin in the bolt carrier assembly so as to block its removal while the charging handle is mounted to the bolt carrier assembly. The charging handle therefore serves dual purposes, thereby providing an efficient design with minimal parts.

In one aspect, a firearm with side-mounted charging handle comprises: a longitudinal axis; a receiver defining a longitudinal cavity; a barrel coupled to the receiver, the barrel comprising a front muzzle end, a rear breech end, and an internal bore extending axially between the ends to define a projectile passageway; a bolt carrier assembly movably disposed in the longitudinal cavity of the receiver, the bolt carrier assembly collectively comprising a bolt carrier and a bolt disposed at least partially inside a forwardly open bolt cavity in the bolt carrier; the bolt carrier assembly being axially moveable between a forward closed breech position in battery with the barrel and a rearward open breech position; a firing pin disposed in a firing pin passage formed longitudinally in the bolt, the firing pin axially movable between a forward striking position for contacting a chambered cartridge in the barrel and a rearward ready-to-fire position; a charging handle detachably mounted to the bolt carrier assembly, the charging handle comprising a mounting pin member passing transversely through the bolt carrier between first and second lateral sides thereof, and a grasping member projecting transversely outwards from the first lateral side of the bolt carrier; the charging handle operable to manually cycle the bolt carrier assembly from the forward closed breech position to the rearward open breech position via the grasping member; wherein the mounting pin member of the charging handle is configured and positioned to retain the firing pin in the bolt carrier by blocking withdrawal of the firing pin from the bolt carrier assembly. In one embodiment, the mounting pin member of the charging handle is engageable with a diametrically enlarged annular retention flange on the firing pin, the mounting pin member operable to block rearward withdrawal of the firing pin from the firing pin passage of the bolt. The firearm further comprises a retention clip detachably engaged with a free terminal end of the mounting pin member of the charging handle which projects transversely outwards into an elongated lateral opening formed in the second lateral side of the bolt carrier.

According to another aspect, a method for coupling a charging handle to a side of a bolt carrier assembly of a firearm comprises: providing a bolt carrier assembly defining a longitudinal axis and including a bolt carrier and a bolt supported by the bolt carrier, and the charging handle including a mounting pin member and a grasping member for manually actuating the charging handle; placing the charging handle against a first lateral side of the bolt carrier; inserting the mounting pin member of the charging handle laterally through a through passage formed in the bolt carrier in a direction transverse to the longitudinal axis; projecting a terminal end of the mounting pin member outwards from a second lateral side of the bolt carrier; detachably coupling a retention clip to the terminal end of mounting pin member; wherein the retention clip fixedly couples the charging handle to the first lateral side of the bolt carrier. In one embodiment, the detachably coupling step includes sliding the retention clip parallel to the longitudinal axis from an unlocked position to a locked position engaged with the mounting pin member.

According to another aspect, a bolt carrier assembly of a firearm with side-mounted charging handle comprises: a longitudinal axis; a bolt carrier; a bolt disposed at least partially inside a forwardly open bolt cavity in the bolt carrier; a firing pin disposed in a firing pin passage formed longitudinally in the bolt, the firing pin axially movable between a forward striking position for contacting a chambered cartridge in the barrel and a rearward ready-to-fire position; a charging handle detachably mounted to the bolt carrier, the charging handle comprising a mounting pin member passing transversely through the bolt carrier between first and second lateral sides thereof, and a grasping member projecting transversely outwards from the first lateral side of the bolt carrier for manually operating the bolt carrier assembly; wherein the mounting pin member of the charging handle is configured to cooperate with and retain the firing pin in the bolt carrier to block withdrawal of the firing pin from the bolt carrier assembly.

BRIEF DESCRIPTION OF THE DRAWINGS

The features of the exemplary embodiments will be described with reference to the following drawings where like elements are labeled similarly, and in which.

Figure 1:
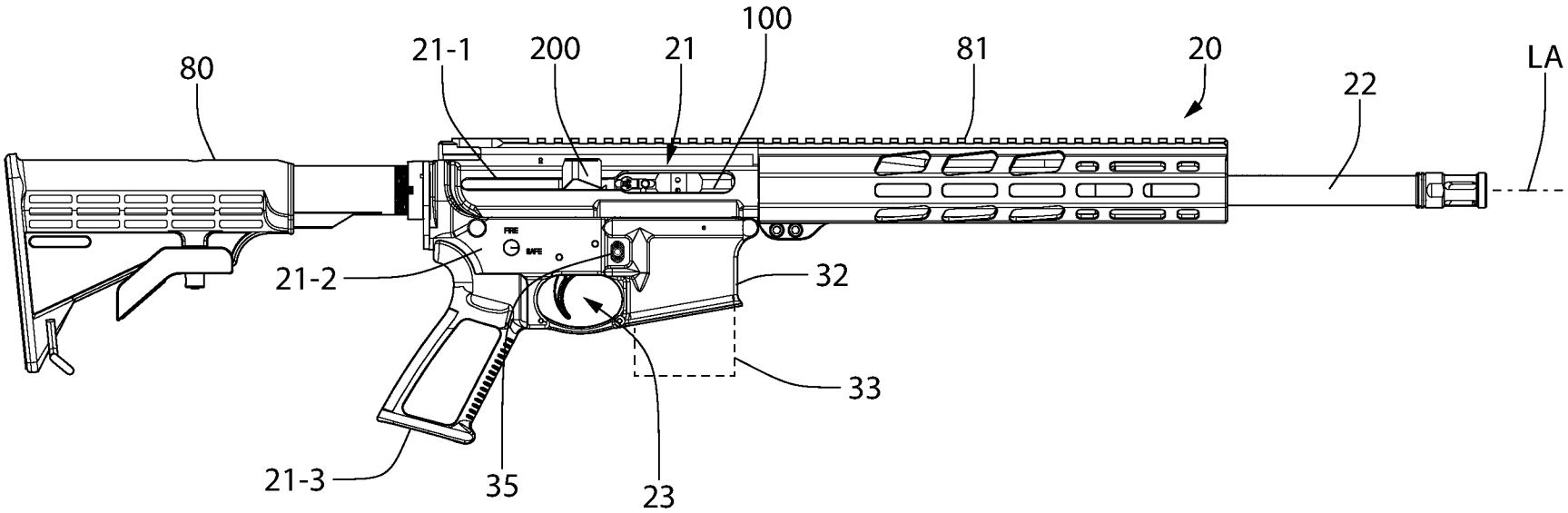
FIG. 1 is a side view of a side-mounted ambidextrous charging handle for a firearm according to the present disclosure.
Figure 2:
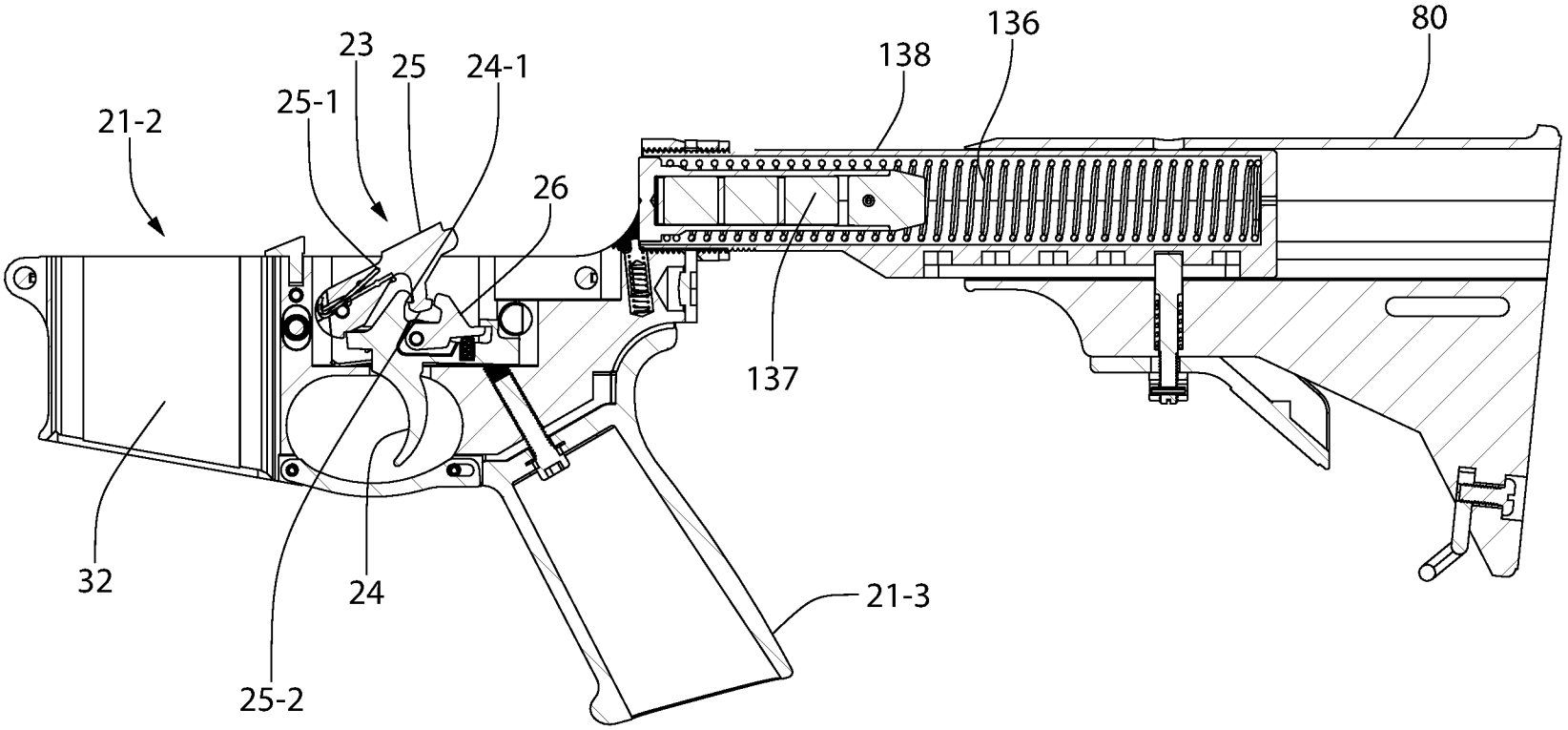
FIG. 2 is a left side cross-sectional of a lower receiver thereof.
Figure 3:
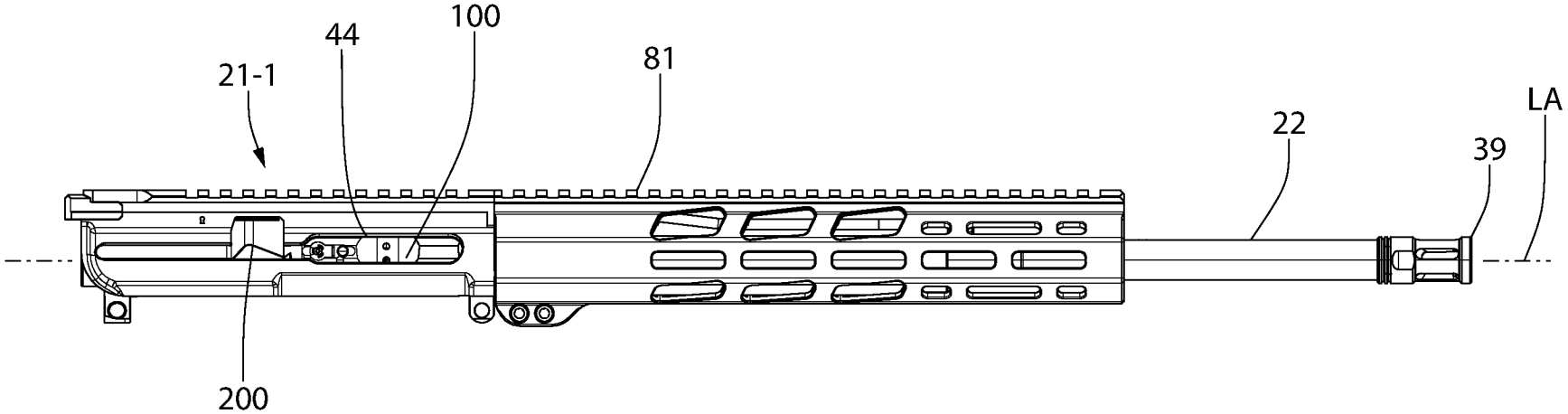
FIG. 3 is a right side view of an upper receiver the firearm coupleable to the lower receiver.
Figure 4:
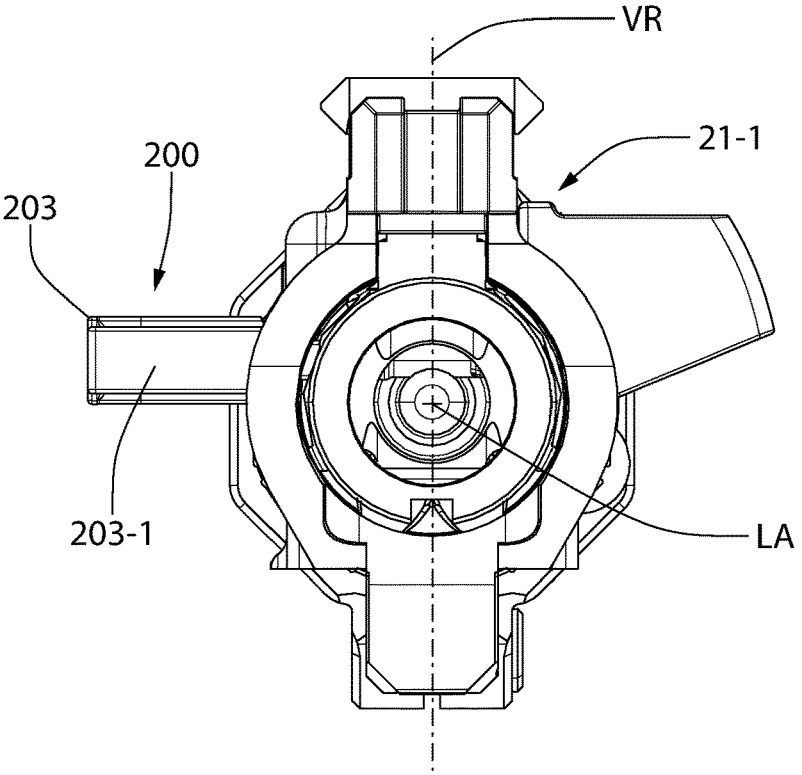
FIG. 4 is a front view thereof.
Figure 5:
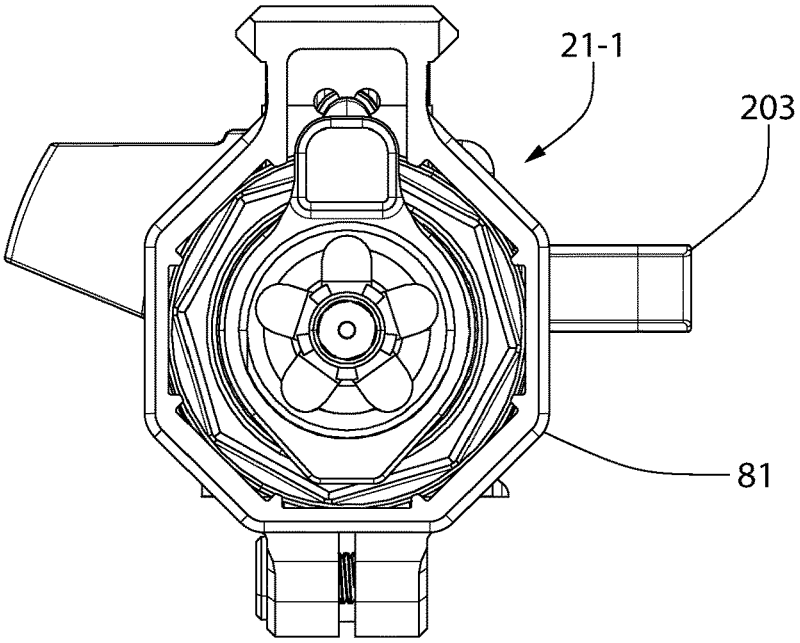
FIG. 5 is a rear view thereof.
Figure 6:
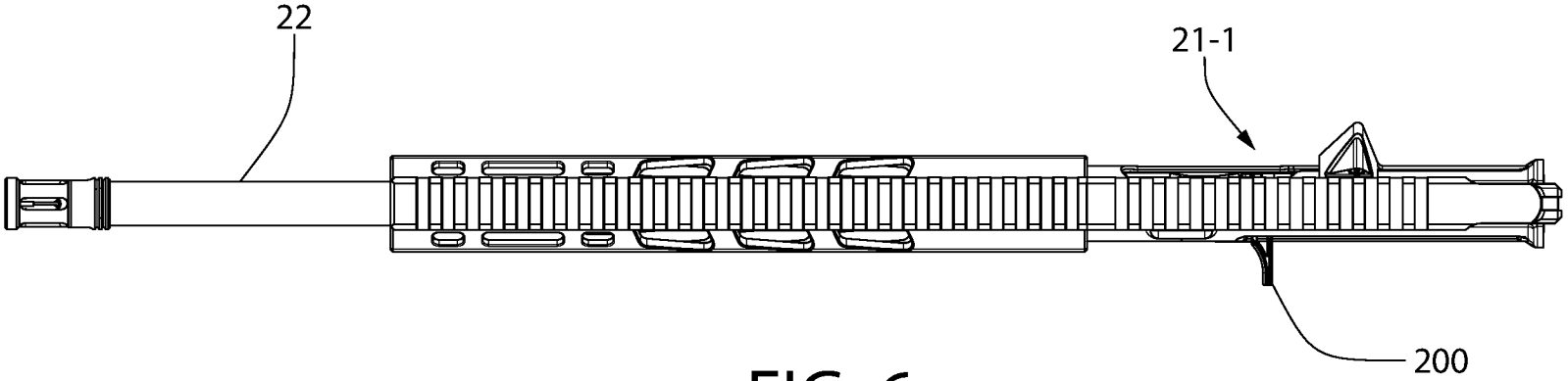
FIG. 6 is a top view thereof.
Figure 7:
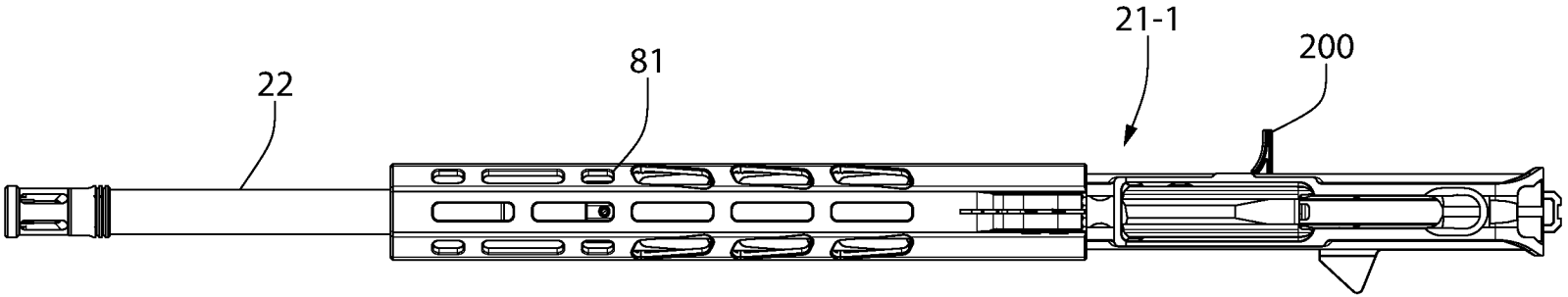
FIG. 7 is a bottom view thereof.

All drawings are schematic and not necessarily to scale. Parts and features shown and given a reference numerical designation in one figure may be considered to be the same parts where they appear in other figures without a numerical designation for brevity unless specifically labeled with a different part number and described herein.

DETAILED DESCRIPTION OF EMBODIMENTS

The features and benefits of the invention are illustrated and described herein by reference to preferred but non-limiting exemplary ("example") embodiments. This description of the embodiments is intended to be read in connection with the accompanying drawings, which are to be considered part of the entire written description. Accordingly, the invention expressly should not be limited to such embodiments illustrating some possible non-limiting combination of features that may exist alone or in other combinations of features; the scope of the invention being defined by the claims appended hereto.

In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation. Terms such as "attached," "affixed," "connected," "coupled," "interconnected," and similar refer to a relationship wherein structures may be secured or attached to one another either directly or indirectly through intervening structures, as well as both movable or rigid attachments or relationships, unless expressly described otherwise.

As may be recited in the present disclosure, any ranges disclosed herein are used as shorthand for describing each and every value that is within the range. Any value within the range can be selected as the terminus of the range. In addition, any references cited herein are hereby incorporated by reference in their entireties. In the event of a conflict in a definition in the present disclosure and that of a cited reference, the present disclosure controls.

FIGS. 1-29 depict various aspects of a magazine-fed auto-loading semi-automatic firearm 20 including a side-mounted charging handle according to the present disclosure. In one non-limiting embodiment, the firearm as illustrated may be an AR-type rifle. However, the firearm could be any other type of long gun such as a AR-type carbine with shorter barrel, or non AR-type rifles and carbines. Accordingly, the barrel mounting system is not limited in its applicability to any particular firearm format alone in which it is desirable to provide a side-mounted charging handle.

Referring generally to FIGS. 1-29, as applicable, firearm 20 includes a longitudinal axis LA, receiver 21, barrel 22 coupled thereto, bolt carrier assembly 100, and a trigger-actuated firing mechanism 23 which may be supported by the receiver. The firearm may also include a buttstock 80 coupled to the rear of the receiver 21 and a handguard 81 mounted to and extending from the front of the receiver which covers and surrounds at least a portion of the length of the barrel 22.

A downwardly open magazine well 32 is formed by the receiver 21 which holds an ammunition magazine 33 (represented schematically by dashed lines in FIG. 1) detachably mounted in the well and comprising a plurality of cartridges. Such magazines may a straight or curved box-style which contains a spring-biased stack of ammunition cartridges which are uploaded into the breech area of the receiver by a magazine spring and follower mechanism well known in the art for chambering into the rearwardly open chamber 36 of barrel 22 by the bolt carrier assembly 100 in a conventional manner when cycling the action. In one embodiment for an AR-type firearm, the cartridges may be centerfire cartridges with a centrally located percussion cap in the rear exposed end of the base of the cartridge which are struck by the firing pin to discharge the firearm. Such cartridge and magazines are well known to those skilled in the art without further undue elaboration.

The magazine 33 is removably retained in the magazine well 32 by a movable magazine catch or latch 35. Latch 35 may be mounted proximate to the rear of the magazine well 32 and is configured to engage and retain magazine 33 in the firearm. To release the magazine 33 from the firearm 20, the user presses the latch.

Barrel 22 has an elongated tubular body including an axial bore 37 extending longitudinally and axially from a rear breech end 38 to a front muzzle end 39 from which a bullet or slug is discharged from the firearm. The centerline of bore 37 is coaxial with and defines the longitudinal axis LA of the firearm. Because the bolt 120 of the bolt carrier assembly 100 is coaxial with bore 37 of barrel 22 for forming a closed and locked breech, it bears noting that the longitudinal axis LA extends through the bolt and bolt carrier which share the same longitudinal axis applicable for reference with respect to the bolt carrier assembly 100. A vertical reference plane VR intersects and extends along the longitudinal axis LA for convenience of description (see, e.g., FIGS. 4 and 20). The rear breech end 38 of the barrel 22 defines a rearwardly open diametrically enlarged chamber 36 configured for holding an ammunition cartridge. Chamber 36 communicates with bore 37 which forms the projectile passageway for the bullet or slug.

Figure 9:
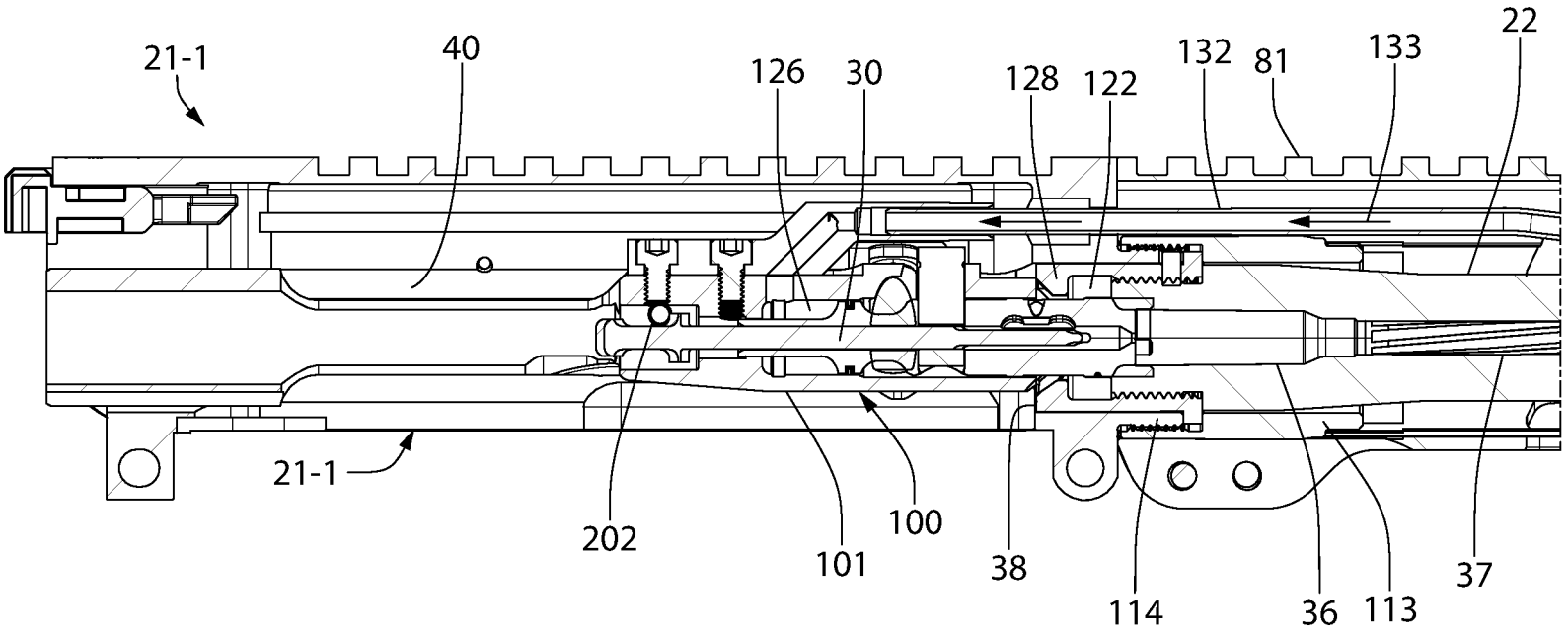
FIG. 9 is an enlarged detail taken from FIG. 8.
Figure 10:
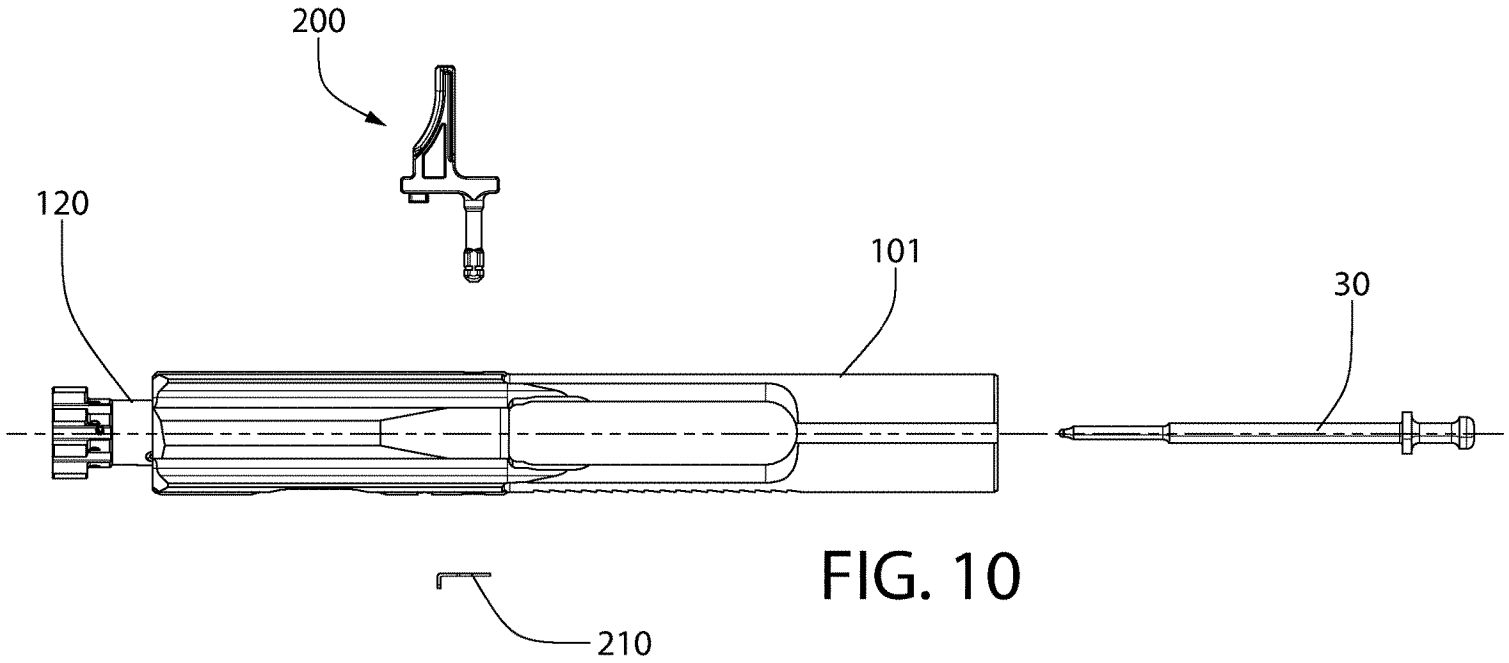
FIG. 10 is a bottom partial exploded view of the bolt carrier assembly of the firearm showing the side-mounted charging handle.
Figure 11:
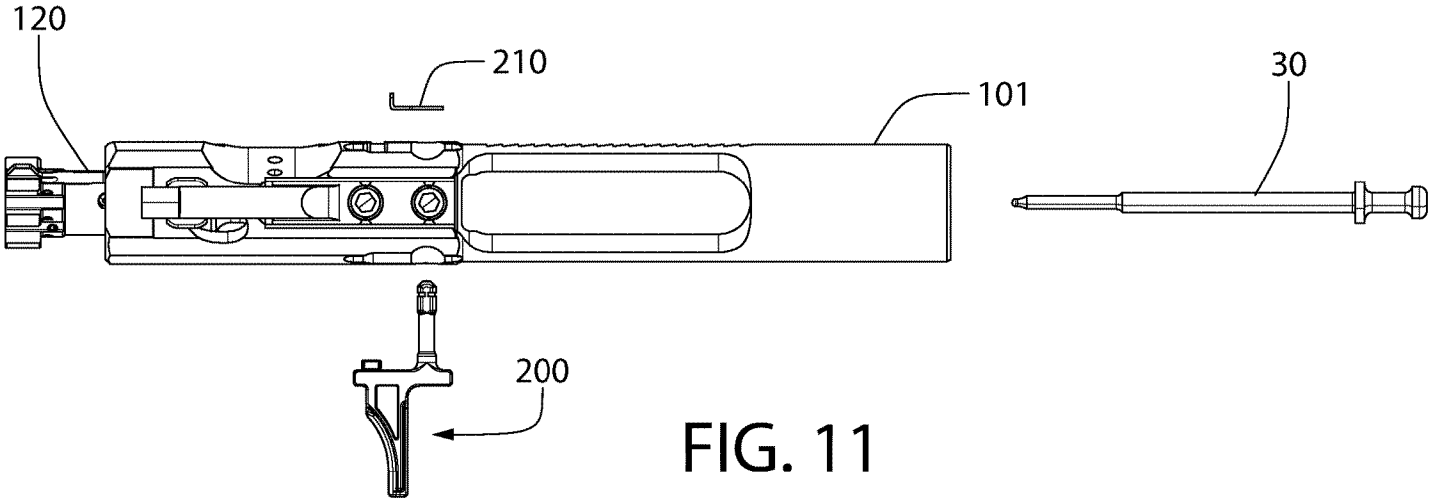
FIG. 11 is a top partial exploded view thereof.
Figure 23:
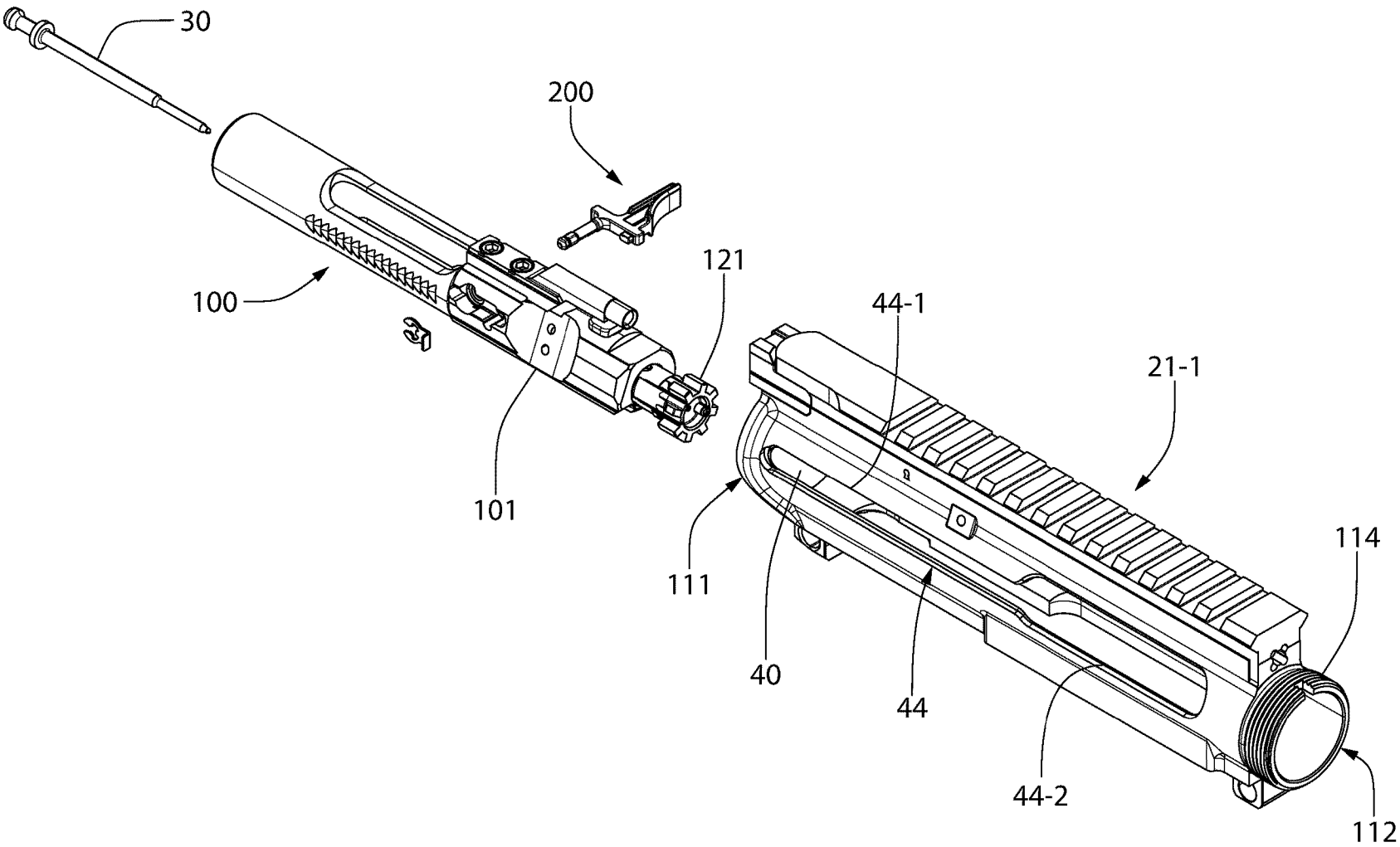
FIG. 23 is a top exploded view of the upper receiver, bolt carrier assembly, charging handle, and firing pin.

Receiver 21 defines an axially elongated internal longitudinal cavity 40 which slidably carries and supports the bolt assembly 100 (see, e.g., FIGS. 9 and 23). Cavity 40 extends along the longitudinal axis LA between open front end 112 of the receiver in communication with the barrel chamber 36 for loading cartridges therein, and open rear end 111 of the receiver in communication with the buffer tube 138 (see, e.g., FIG. 23). Barrel 22 is coupled to the front end 112 of the receiver, such as without limitation forwardly and axially projecting external threaded nipple 114 to form a rotary threaded coupling in one embodiment. Other coupling methods may be used. In one non-limiting embodiment, the right and left lateral sides of the receiver 21 each includes an axially elongated operating slot 44 which communicates with internal longitudinal cavity 40 of receiver 21 which movably carries the barrel carrier assembly 100 therein. A rear portion 44-1 of slot 44 provides a space through which charging handle 200 may be coupled to bolt carrier assembly 100 for rearward and forward movement when cycling the action (e.g., bolt carrier assembly 100) manually or automatically via firing the firearm. An enlarged front portion 44-2 of slot 44 provides an ejection port through which spent cartridge casings are ejected from the firearm after firing by cycling the action. As shown in FIG. 23, front portion 44-2 may have a greater height for this purpose than rear portion 44-1 used to couple the charging handle to the bolt carrier assembly. Slot 44 on both the right and left lateral sides of the firearm may be identical in configuration (including dimensions). The slot 44 may be formed in an upper receiver 21-1 of the receiver 21 in one embodiment of an AR-type firearm, as described below.

In one non-limiting embodiment, firearm 20 may be an AR-type auto-loading semi-automatic firearm as previously noted. In such a firearm, with reference to FIGS. 1, 2, and 8-9, the receiver comprises an upper receiver 21-1 detachably coupled to a lower receiver 21-2 which is a well known construction in the art for AR-type rifles or carbines without further elaboration necessary. The bolt carrier assembly 100 is movably mounted in the upper receiver (see, e.g., FIGS. 8-9). Upper receiver 21-1 in this embodiment defines the internal longitudinal cavity 40 for housing the bolt carrier assembly 100, an open rear end 111, and open front end 112; both which are in communication with the cavity 40. Bolt carrier assembly 100 is insertable forward in the longitudinal/axial direction into cavity 40 when assembling the firearm (see, e.g., FIG. 23). Barrel 22 is detachably coupled to the front end 112 of upper receiver 21-1 via any conventional means, such as for example without limitation an internally threaded barrel nut 113 which threadably engages an external threaded nipple 114 on the front end of the upper receiver 21-1 (see, e.g., FIGS. 9 and 23). Other coupling methods may be used.

The trigger-actuated firing mechanism 23 is mounted in the lower receiver (see, e.g., FIG. 2), which in one embodiment may include a detachably coupled pistol grip 21-3 as shown. In other embodiments, a one-piece receiver may be provided for other type long guns (e.g., rifles or carbines).

The firing mechanism 23 may generally include the following components mounted in the lower receiver 21-2: a movable trigger 24 for actuating the firing mechanism; a pivotable and cockable spring-biased hammer 25; and a pivotable disconnector 26 operably interfaced between the trigger and hammer. Hammer 25 is biased forward towards the firing position by hammer spring 25-1, which may be any suitable type torsion or helical compression spring. Trigger 24 may be configured and operable to hold the hammer in a rear cocked position (see, e.g. FIG. 2) and release the hammer forward to strike the firing pin in response to a trigger pull. In the illustrated embodiment, trigger 24 includes a sear hook 24-1 engageable with a mating sear catch 25-2 formed on a portion of the hammer. Pulling the trigger 24 rearward operates to disengages sear hook 24-1 from catch 25-2 on the hammer, thereby releasing spring-biased hammer 25 forward which strikes the rear end of firing pin 30 slidably carried by the bolt 120 of the bolt carrier assembly 100. This drives the firing pin forward to strike a chambered cartridge held in the chamber 36 of the barrel 22 for discharging the firearm 20. The disconnector 26 is configured to temporarily engage and retain the hammer in the rear cocked position (which is automatically reset by the bolt carrier assembly 100 moving rearward after firing) until the user releases the trigger 24 to re-engage the hammer.

Referring initially now to FIGS. 8-29, bolt carrier assembly 100 is collectively comprised of and generally includes outer bolt carrier 101 and bolt 120 rotatably disposed inside the carrier. Bolt carrier assembly is axially moveable between a forward closed breech position in battery with the barrel 22 and a rearward open breech position spaced longitudinally apart and disengaged from the barrel for extracting and ejecting a fired or spent cartridge from the chamber in a conventional manner after firing the firearm.

Bolt carrier 101 has an axially elongated generally tubular body extending along longitudinal axis LA of the firearm an defining an open front end 102, rear end 103, and an internal forwardly and rearwardly open bolt cavity 104 extending longitudinally/axially between the ends. Rear end 103 may be open in one embodiment to facilitate removal of firing pin 30 from bolt carrier assembly 100. The front portion of bolt carrier 101 comprises a forwardly open bolt cavity 104. Cavity 104 may be configured to house and carry the bolt 120 at least partially therein as shown such that at least the bolt head 121 at front end 124 of the bolt 120 projects forward from the bolt carrier and is exposed to selectively lockingly engage the rear breech end of the barrel 22 for forming a locked breech during firing, as further described herein. The rear part of bolt cavity 104 may be open and leads into a diametrically enlarged firing pin retention chamber 105 formed in the bolt carrier 101 rearward of the bolt 120. Retention chamber is laterally open through the right lateral side 107 and left lateral side 108 of the bolt carrier 101 and rearwardly open into a hammer slot 106 formed in the rear portion of the bolt carrier. Hammer slot 106 is upwardly and downwardly open to allow hammer 25 of firing mechanism 23 to pivots forward therein to strike the rear end 32 of firing pin 30 to discharge the firearm. The rear portion of bolt carrier 101 may include a longitudinally-extending passage 110 which communicates with the hammer slot and allows removal of the firing pin therethrough and the open rear end 103 of the bolt carrier.

Figure 28:
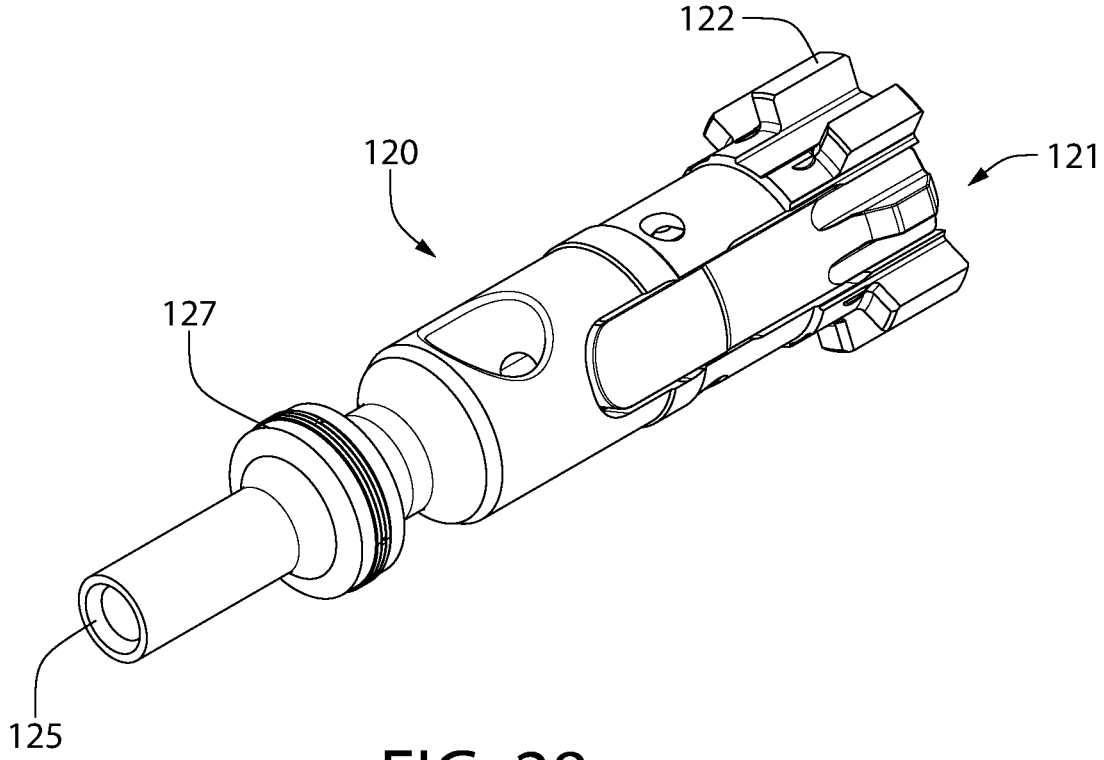
FIG. 28 is a first perspective of the bolt of the bolt carrier assembly.
Figure 29:
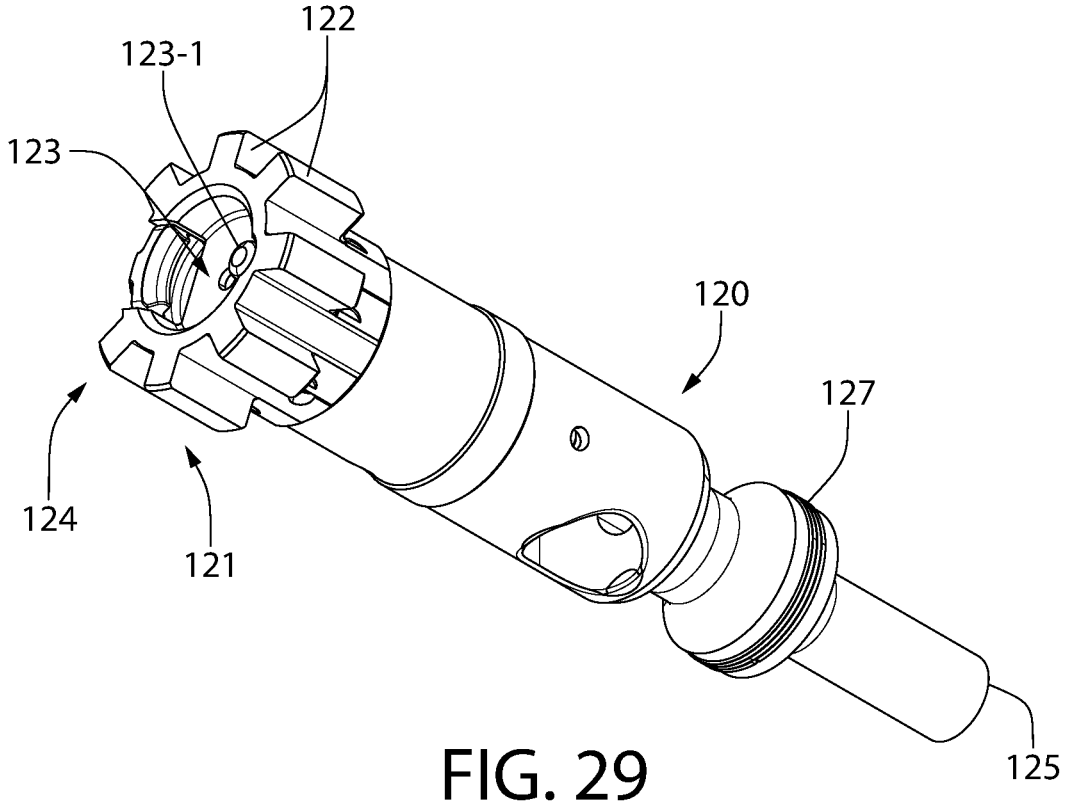
FIG. 29 is a second perspective view of the bolt.

Bolt 120 has an axially elongated body of generally cylindrical shape (albeit with varying diameter portions) and may have a monolithic unitary structure in some embodiments. Bolt 120 defines a longitudinal firing pin passage 34 therein extending from front end 124 to rear end 125; the rear end being open to insert firing pin 30 at least partially therein. Front end 124 of bolt 120 defines forward facing vertical breech face 123 that is insertable into rear breech end 38 of the barrel 22 in battery therewith to abut the rear cartridge chamber 36 and rear of the chambered cartridge for forming a closed breech during firing (see, e.g., FIG. 9). Breech face 123 includes a firing pin aperture 123-1 through which narrowed front end 31 of firing pin 30 can be projected therethrough via a hammer strike (actuated by a trigger pull) to strike a chambered cartridge and discharge the firearm in a conventional manner. The breech face 123 may be recessed into the front end 1224 of bolt 120 as shown in some embodiments. FIGS. 28-29 show bolt 120 in isolation.

During assembly of the bolt carrier assembly 100, the bolt 120 is inserted rearward through the open front end of bolt cavity 104 formed in bolt carrier 101.

Bolt head 121 at front end 124 of bolt 120 include a plurality of radial bolt lugs 122 which are engageable with a plurality of mating radial bolt locking lugs 128 formed at rear breech end of barrel 22 (see, e.g., FIG. 9). Bolt lugs 122 are insertable forward between bolt locking lugs 128 when the bolt carrier assembly 100 is in battery with rear breech end 38 of barrel 22. Once forward of the bolt locking lugs, bolt 120 is then rotated which in turn rotates bolt lugs 122 in front of the bolt locking lugs to an interference position, thereby forming an interlock therebetween and locked breech during firing in a conventional manner. For AR-type firearms, bolt 120 is automatically rotated via a cam pin 129 fixedly coupled to the bolt when slideably engages a corresponding curved cam slot 130 formed in bolt carrier 101 (see, e.g., FIGS. 17 and 22). After firing the firearm, as the bolt carrier 101 travels rearward to open the breech, interaction between cam pin 129 and cam slot 130 operates to rotate the bolt to unlock the breech, thereby allowing the bolt to be withdrawn axially rearward from the barrel and barrel bolt locking lugs 128 therein. This manner of operation is well known in the art.

Figure 8:
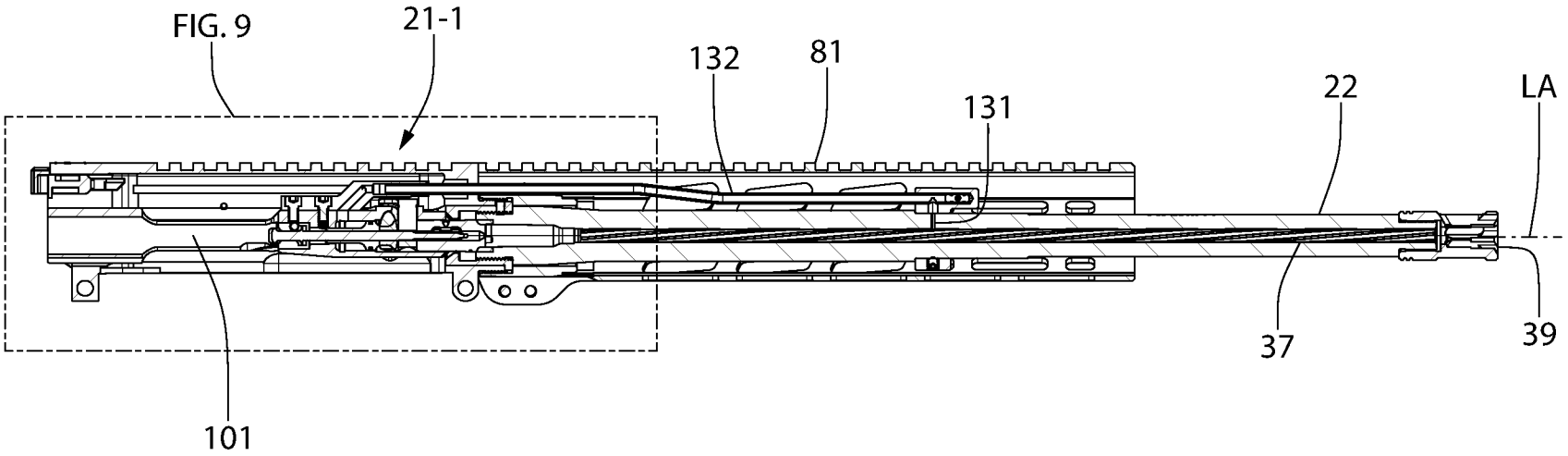
FIG. 8 is a side cross sectional view thereof.
Figure 22:
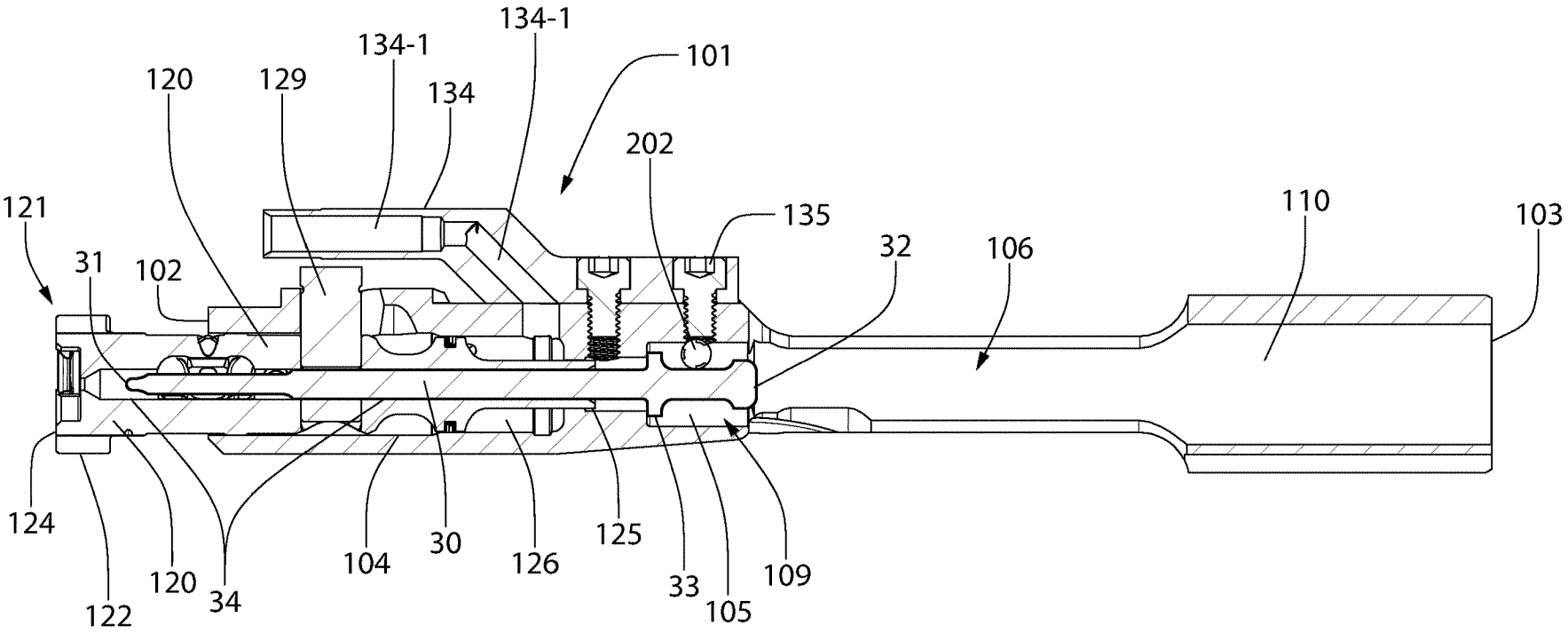
FIG. 22 is a left side cross sectional view showing the firing pin installed in the bolt carrier assembly and the transverse mounting pin member of the charging handle in a blocking position relative to a retention flange of the firing pin inside the bolt carrier.

In one embodiment, firearm 20 may be a gas-operated AR-type firearm which uses combustion gas from firing to cycle the action (i.e. bolt carrier assembly 100) between the forward closed breech and rearward open breech positions. Firearm 20 may be configured as a direct impingement gas operating system as shown. Referring to FIGS. 8-9 and 22, highly pressured combustion gas is bled off of the barrel bore 37 via gas extraction port 131. A longitudinally-extending gas tube 132 conveys the extracted gas rearward to gas key 134 detachably mounted to bolt carrier 101 via threaded fasteners 135 (see directional gas flow arrows 133 in FIG. 9). Gas key 134 defines an internal gas passage 134-1 which fluidly couples gas tube 132 to gas chamber 126. The pressurized gas stream enters gas chamber 126 formed inside bolt cavity 104 in the bolt carrier around an intermediate portion of bolt 120. Bolt 120 includes a gas seal rings 127 located in the forward portion of gas chamber 126 to prevent the high pressure gas from leaking forward out of the bolt carrier (see, e.g., FIGS. 22 and 28-29). The pressurized gas fills gas chamber 16 and drives the entire bolt carrier assembly 100 rearward after firing, thereby unlocking and opening the breech to allow the used or spent cartridge to be extracted from chamber 36 and ejected from the firearm.

The bolt carrier assembly 100 (bolt carrier 101 and bolt 120 therein) travels fully rearward to the open breech position. This drives cylindrical buffer member 137 located inside axially elongated buffer tube 138 coupled to buttstock 80 rearward in turn, thereby compressing buffer or recoil spring 136 (see also FIG. 2). Buffer tube 138 is coaxially aligned with longitudinal axis LA of the firearm defined by the barrel 22 previously described herein. Recoil spring 136 may conventionally be a helical compression spring in one embodiment. The compressed recoil spring then converts the stored mechanical potential energy back to kinetic energy as the spring re-expands. This drives the bolt carrier assembly 100 back forward to the closed breech position. This mechanism and operation is known in the art.

It bears noting that in other embodiments, an indirect gas piston operating system also used and known in the art for AR-type firearms ay be provided instead for firearm 20. In this type system, the high pressure combustion gas is used to drive a piston and rod assembly rearward which interacts with the bolt carrier assembly to drive it rearward to open the breech after firing. The gas does not enter the bolt carrier in such a design. The present side-mounted charging handle may be used with equal benefit for either direct impingement or indirect gas operating systems. Accordingly, the invention is not limited to either type gas operating system.

Referring to FIG. 22, firing pin 30 is carried in longitudinal firing pin passage 34 of bolt 120. The firing pin retention chamber 105 formed in the bolt carrier 101 rearward of the bolt 120 receives diametrically enlarged annular retention flange 33 on the firing pin. Retention chamber 105 is rearwardly open and dimensioned to allow the retention flange 33 and firing pin 30 to be withdrawn in an axial rearward direction from the bolt 120 and bolt carrier 101 for removal. The opening in rear end 125 of bolt 120 positioned forward of retention chamber 105 conversely is dimensioned smaller than the diameter of retention flange 33 to prevent the firing pin 30 from advancing any farther forward. It bears noting that FIG. 22 shows the bolt carrier assembly 100 in an open breech position. When the breech is closed and bolt carrier 101 is in battery with the barrel 22, bolt 120 would retract farther rearward inside the bolt carrier, thereby placing the narrowed front end 31 of firing pin 30 closer to firing pin aperture 123-1 in breech face 123 in the bolt head 124 at front so that the firing pin can be projected forward when struck by the hammer to contact the chambered cartridge and discharge the firearm. It is also worth noting that the retention chamber 105 also prevents the firing pin from traveling forward when the firearm is out of battery. When the firearm is out of battery, as shown in FIG. 22, the large retention flange 33 on the firing pin 30 contacts the front of the "retention chamber" to limit it forward motion and prevent the firing pin from firing the firearm when not in battery. When the firearm is in-battery, the entrance to the small diameter firing pin passage 34 at the rear end 125 of bolt 120 travels/shifts axially rearward, and then acts as the firing pin stop to limit forward motion and prevent excess cartridge primer indent by engaging the retention flange 33.

Figure 19:
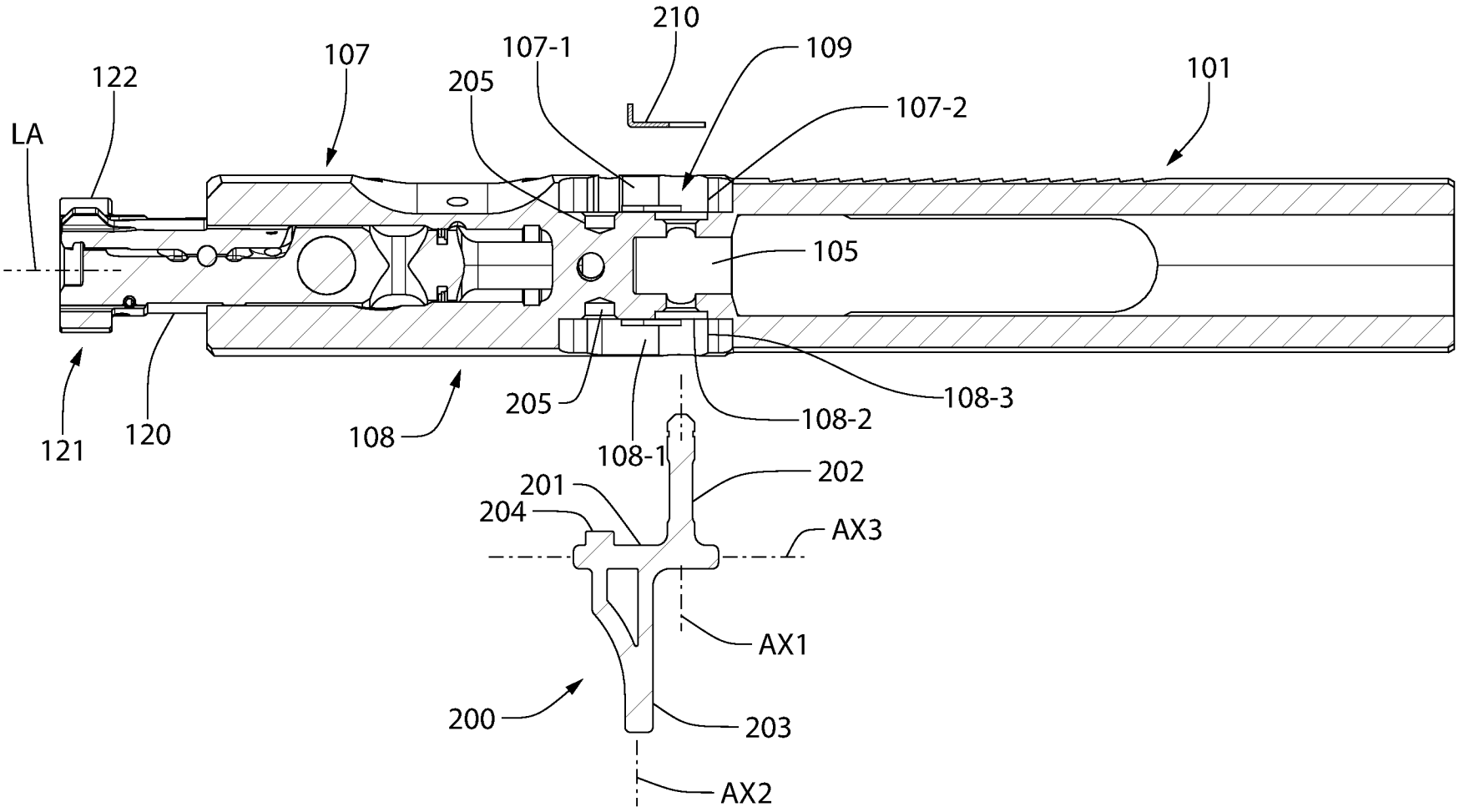
FIG. 19 is an exploded longitudinal cross sectional view thereof showing the charging handle disengaged from the bolt carrier assembly.
Figure 24:
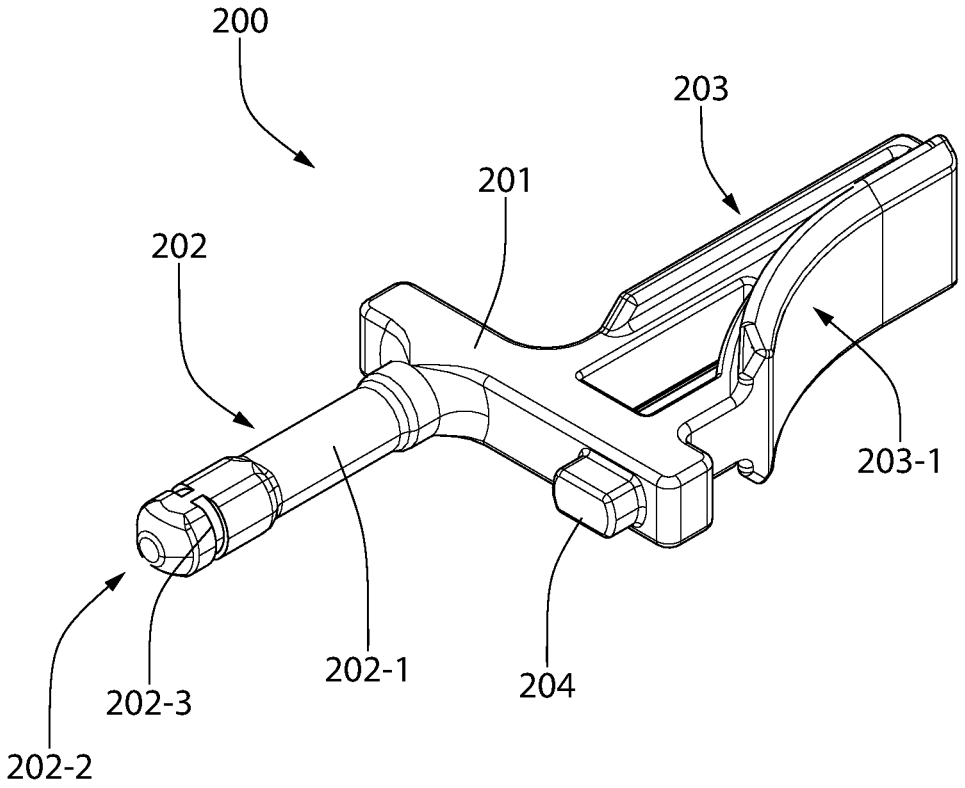
FIG. 24 is a perspective view of the charging handle in isolation.
Figure 25:
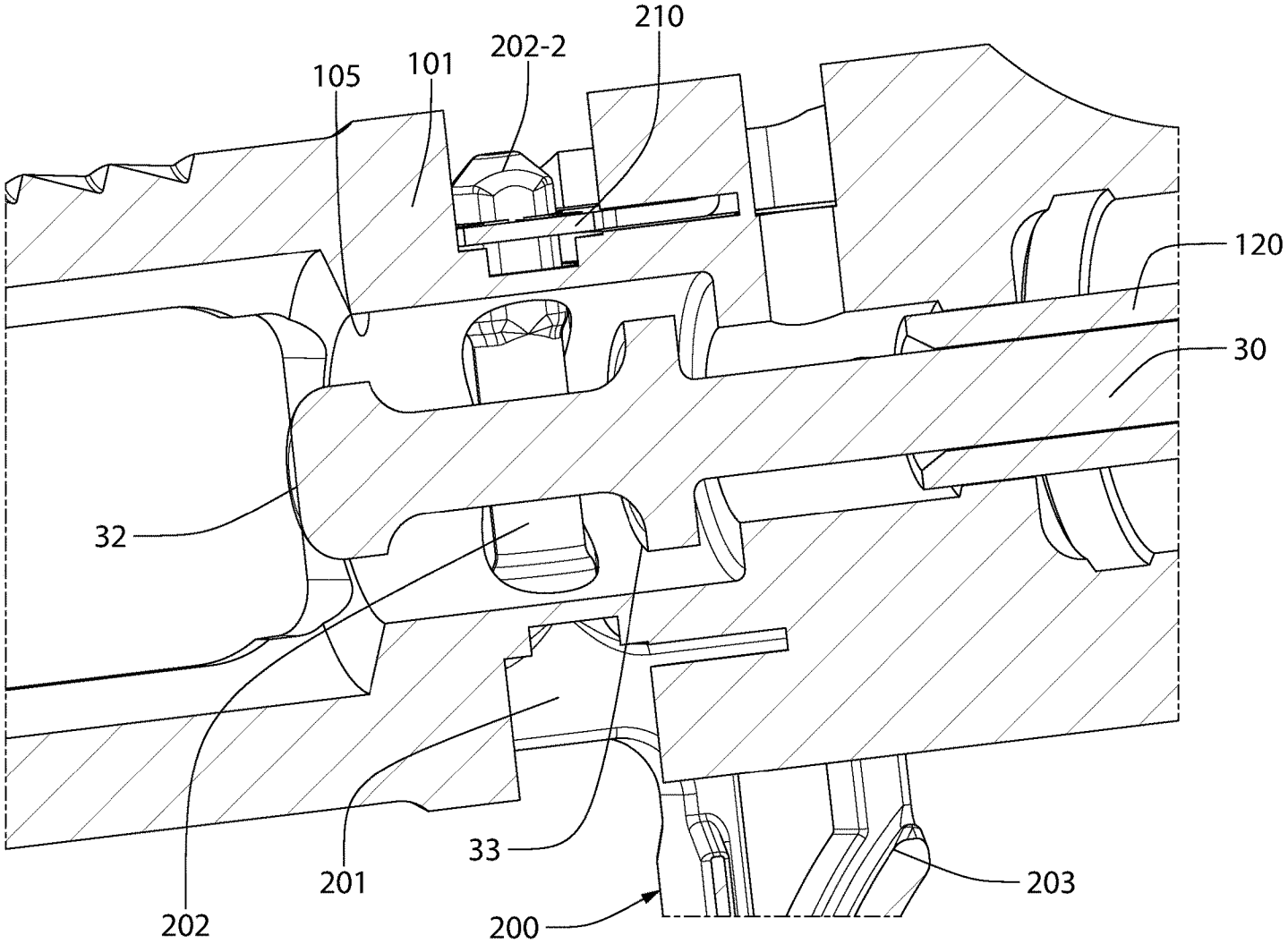
FIG. 25 is an enlarged cross sectional view showing a portion of the bolt carrier of the bolt carrier assembly and the transverse mounting pin member of the charging handle operably interfaced with the diametrically enlarged retention flange of the firing pin inside the firing pin retention chamber of the bolt carrier.

The side-mounted charging handle 200, which is shown in top view in FIG. 19 and in isolation and greater detail in FIG. 24, will now be further described.

Referring to the foregoing figures and in general to FIGS. 1-27 as applicable, charging handle 200 generally includes a multi-membered body including a longitudinal central base member 201, mounting pin member 202, grasping member 203, and locating protrusion 204. Central base member 201 is longitudinally/axially elongated and oriented parallel to the longitudinal axis LA of the firearm when charging handle 200 is coupled to the bolt carrier mounted in turn to the receiver 21 (e.g., upper receiver 21-1). Base member 201 may be substantially straight and linear in one embodiment as shown. The central base member serves as hub to which the other parts of the charging handle are fixedly connected and/or integrally formed. Mounting pin member 202 and grasping member 203 each are oriented and extend perpendicularly to central base member 201.

The mounting pin member 202 of the charging handle defines a first pin axis AX1 which is parallel to but longitudinally offset from a second handle axis AX2 defined by the grasping member 203 of the charging handle (see, e.g., FIG. 19). The axes AX1 and AX2 are oriented transverse (e.g., perpendicular) to the longitudinal axis LA of the firearm 20 when the handle is mounted to the bolt carrier assembly 100. Central base member 201 defines a third base axis AX3 which is perpendicular to axes AX1 and AX2 as shown. Mounting pin member 202 may be disposed on a rear portion of central base member 201 whereas grasping member 203 may be disposed on a front portion of the central base member.

The mounting pin member 202 of the charging handle 200 is configured and operable to both mount the charging handle to the bolt carrier assembly 100 and further functions in the non-limiting illustrated embodiment to retain the firing pin 30 in the bolt carrier assembly. Mounting pin member 202 projects inwards from the charging handle (e.g., central base member 201) towards and through the bolt carrier assembly 100 between the lateral sides 107, 108 of bolt carrier 101 when mounted thereto. Specifically, lateral windows or openings 107-1 and 108-1 formed and recessed into the right and left lateral sides 107, 108 of the bolt carrier 101 intersect and are in communication with by the laterally, rearwardly, and forwardly open firing pin retention chamber 105 in the bolt carrier 101, thereby collectively forming a transversely oriented through passage 109 through the bolt carrier from side to side. The charging handle mounting pin member 202 is insertable through the transverse through passage 109 between the lateral sides of the bolt carrier as shown for example in FIGS. 9 and 20.

The lateral openings 107-1, 108-1 of bolt carrier 101 may have any suitable shape for the intended function, including longitudinally/axially elongated slots as shown. The portion of the lateral openings which defines parts of the transverse through passage 109 extending laterally through bolt carrier 101 defines circular apertures 107-2, 108-2 complementary configured to and dimensioned close to but slightly larger than the cylindrical engagement section 202-1 of mounting pin member 202 of charging handle 200. This provides a close yet slideable fit between the mounting pin member and circular apertures to prevent excessive looseness and wobbling of the charging handle when manually actuated by the user. The cylindrical engagement section 202-1 of the charging handle mounting pin member 202 passes through and is positioned within the laterally open firing pin retention chamber 105 formed in the bolt carrier rearward of the bolt 120.

Mounting pin member 202 of charging handle 200 is configured to prevent axial withdrawal of the firing pin 30 rearward from the bolt carrier assembly 100 (i.e. bolt 120 and bolt carrier 101). The firing pin is normally insertable into the bolt carrier and bolt in a forward axial direction (parallel to longitudinal axis LA) from the rear of the bolt carrier. To accomplish the firing pin retention function, the mounting pin member 202 of the charging handle is engageable and cooperates with a diametrically enlarged annular retention flange 33 disposed on the firing pin. The mounting pin member 202, when inserted transversely/laterally through the transverse through passage 109 of the bolt carrier 101, blocks rearward withdrawal of the firing pin from the bolt carrier assembly 100. The retention flange of the firing pin is positioned in the retention chamber 105 forward of the cylindrical engagement section 202-1 of charging handle mounting pin member 202 (see, e.g., FIGS. 20, 22, and 25). In other words, retention flange 33 engages the charging handle mounting pin member 202 when drawn rearward in the bolt carrier 101 which limits axial movement and prevents complete withdrawal of the retention firing pin any farther rearward than the mounting pin member of the charging handle 200.

When the mounting pin member 202 of charging handle 200 is laterally withdrawn from the bolt carrier 101 (e.g., mounting pin member 202), the firing pin can be axially withdrawn rearward from the bolt 120 and bolt carrier 101 and completely removed.

Advantageously, the present charging handle 200 therefore provides a dual function of both retaining the firing pin 30 in the firearm (bolt carrier assembly 100) and manually cycling/moving the bolt carrier assembly rearward by a user to open the breech of the firearm. This minimizes the number of parts of necessary for the bolt carrier assembly, thereby providing a mechanically simple design of a side-mounted charging handle which reduces the possibility of miscellaneous parts getting lost during disassembly and maintenance (e.g., cleaning) of the firearm. Particularly for direct impingement gas operated autoloading firearms explained above, combustion gas enters the bolt carrier assembly thereby requiring more frequent cleaning of the assembly to remove carbon and soot deposits to maintain a properly functioning firearm in contrast to gas piston operated firearms.

To positively retain and mount the charging handle 200 to the bolt carrier 101, a retention clip 210 detachably engages a free terminal end 202-2 of the charging handle mounting pin member 202 which projects transversely/laterally outwards from the right lateral side 107 of the bolt carrier 101 opposite the left lateral side 108. Terminal end 202-2 may include at least one retention groove 202-3 complementary configured to receive and lockingly engage a pair of spaced apart and resiliently deflectable jaws 211 of retention clip 210 (see, e.g., FIGS. 13, 17-19, and 24). Groove 202-3 may be a circumferentially continuous groove, or in some embodiments as shown in FIG. 24, may alternatively be discontinuous being comprised of a pair of separate grooves. Locking end portion 214 of the retention clip 210 may be C-shaped and defines a pair of resiliently deformable jaws 211 separated at their free ends by a gap which allows insertion of charging handle mounting pin member 202 therethrough into circular central opening 213 formed between jaws. The jaws 211 are operable to selectively engage retention groove 202-3 of mounting pin member 202 to lock the charging handle mounting pin member 202 in the bolt carrier 101. Accordingly, central opening 213 formed between jaws 211 receives the free terminal end 202-2 of charging handle mounting pin member 202 therein when the clip 210 is installed and mounted on one of the two lateral sides 107, 018 (e.g., right side 107 as illustrated) of the bolt carrier 101 (see, e.g., FIGS. 17-18 and 26-27).

The retention clip 210 is configured and operable to selectively engage mounting pin member 202 of charging handle 200 when manually actuated by the user via moving the clip in the axial longitudinal direction. Sliding the retention clip 210 longitudinally against the transversely mounted charging handle mounting pin member 202 deflects and spreads the jaws temporarily apart as the pin member is received into the central opening 213 between the jaws. Once the jaws reach the at least one retention groove 202-3 on the free terminal end of mounting pin member 202, the jaws resiliently snap back towards each other and positively engage the retention groove, thereby locking the charging handle 200 to the bolt carrier 101. Charging handle mounting pin member 202 can no longer be transversely/laterally withdrawn from the bolt carrier 101. Retention clip 201 is preferably formed of a suitable deformable metal having an elastic memory such as spring metal and is operable to form a resilient snap lock engagement with the mounting pin member 202 of charging handle 200 to retain the handle to the bolt carrier assembly 100.

In one embodiment, retention clip 210 may be a detachably mounted self-retained clip which remains slideably coupled to the lateral side of the bolt carrier 101 even when the side-mounted charging handle 200 and its mounting pin member 202 are completely removed from bolt carrier assembly 100. This advantageously eliminates the chance that this relatively small part might be lost when disassembling the bolt carrier assembly 100 for maintenance, particularly in the field if necessary.

With continuing reference to FIGS. 17-18 and 26-27, retention clip 210 may have a generally flat body in which the locking end portion 214 may be generally circular and diametrically enlarged having a greater height than the adjoining rectilinear (e.g., rectangular) front operating end portion 215 of the clip. The arcuately curved top and bottom of the jaws 211 slideably engage and ride forward and rearward in guide grooves 216 on lateral side 107 of the bolt carrier 101 when retention clip 210 is moved between its locked and unlocked positions. The locked and unlocked positions are each axial positions such that the retention clip moves therebetween parallel to and along the longitudinal axis LA of the firearm. In one embodiment, as shown, the locked position may be a rearward axial position and the unlocked position may be a forward axial position. In other possible embodiments, these positions may be reversed such that the locked position is a forward axial position and the unlocked position is a rearward axial position.

Axially elongated operating end portion 215 of the retention clip 210 extending from and lying in the same vertical plane as the locking end portion 214 has a height less than the vertical distance between the top and bottom guide grooves 216 and concomitantly the forward rectangular-shaped portion of lateral opening 107-1 in the bolt carrier 101 in which the guide grooves are formed. Accordingly, the rectangular operating end portion of retention clip 210 does not engage the guide grooves (see, e.g., FIG. 27), but remains slideably movable forward and rearward in the lateral opening between the grooves.

Operating end portion 215 of retention clip defines an operating tab 212 bent perpendicularly (e.g., 90 degrees) outwards with respect to the flat main body of the retention clip as shown for grasping by user. The pair of vertically spaced apart longitudinal guide grooves 216 formed in the body of bolt carrier 101 may be formed within the lateral opening 107-1 on lateral side 107 of the carrier (see, e.g., FIGS. 15 and 26-27). One guide groove is formed at each of the top and bottom of lateral opening 107-1 and may be identical in configuration in one embodiment.

Retention clip 210 is longitudinally/axially slideable in lateral opening 107-1 of bolt carrier 101 between a forward unlocked position and rearward locked position positively engaging mounting pin member 202 of charging handle 200 to detachably couple and retain the handle to the bolt carrier assembly. The longitudinally elongated slot shape of lateral opening 107-1 provides sufficient room for the retention clip 210 to travel axially within the lateral opening between the forward and rearward positions. The longitudinally elongated top and bottom guide grooves 216 control and guide movement of the retention clip and keep the clip engaged with the bolt carrier. It bears noting that the clip 210 cannot be laterally/transversely withdrawn from the bolt carrier 101 so long as the diametrically enlarged locking end portion 214 of the clip remains slideably engaged with and is positioned in the guide grooves 216 cut into the bolt carrier during the clip's forward and rearward travel.

Figure 26:
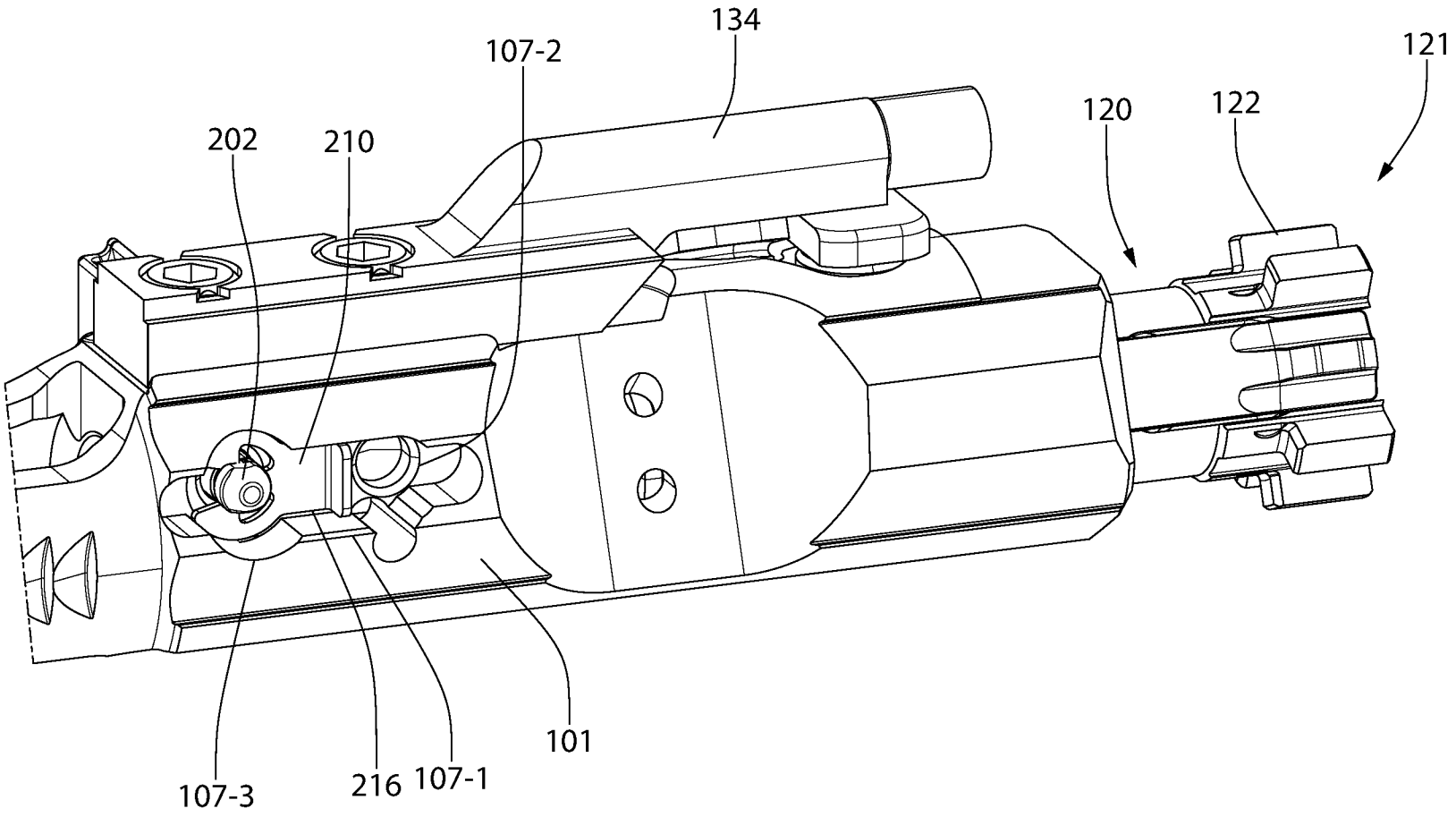
FIG. 26 is a right side perspective view of the bolt carrier showing the axially slideably retention clip engaged with the mounting pin member of the charging handle which couples the handle to the bolt carrier.

When the charging handle 200 is not mounted to the bolt carrier 101 so that the mounting pin member 202 is not positioned in the through passage 109 (including firing pin retention chamber 105) of the bolt carrier, moving the retention clip 210 to its locked position disengages the locking end portion 214 of the clip from the mating guide grooves 216 within the lateral opening 107-1 of the bolt carrier, thereby allowing the clip to be completely removed laterally from the bolt carrier. To facilitate the removal (and installation) of the retention clip, lateral opening 107-1 includes a circular diametrically enlarged removal opening 107-3 configured to receive the diametrically enlarged locking end portion 214 of the retention clip (with jaws 211), as shown in FIGS. 19 and 26. The retention clip guide grooves 216 may at least partially intersect the removal opening 107-3 (see, e.g., FIG. 27). Lateral opening 108-1 on the opposite lateral side 108 of the bolt carrier 101 similarly includes a diametrically enlarged circular removal opening 108-3 for the same purpose and ambidextrous mounting of the charging handle 200, as further described herein.

A process or method for installing a side-mounted charging handle 200 using retention clip 210 will now be briefly described. The retention clip 210 is first moved to the forward unlocked position in lateral opening 107-1 of bolt carrier 101 in preparation for mounting charging handle 200. The pair of jaws 211 and central opening 213 therebetween of the clip are not transversely/laterally aligned with the through passage 109 in the bolt carrier 101 to allow the mounting pin member 202 of charging handle 200 to be fully inserted first transversely through the bolt carrier.

The firing pin 30 is first slideably inserted axially forward from the rear of the bolt carrier 101 until the diametrically enlarged retention flange 33 of the firing pin is positioned in the firing pin retention chamber 105 in bolt carrier 101. Preferably, the firing pin is inserted as far forward as possible until the flange 33 abuttingly engages the front wall of the retention chamber 105 adjacent the rear end of bolt 120.

Figure 27:
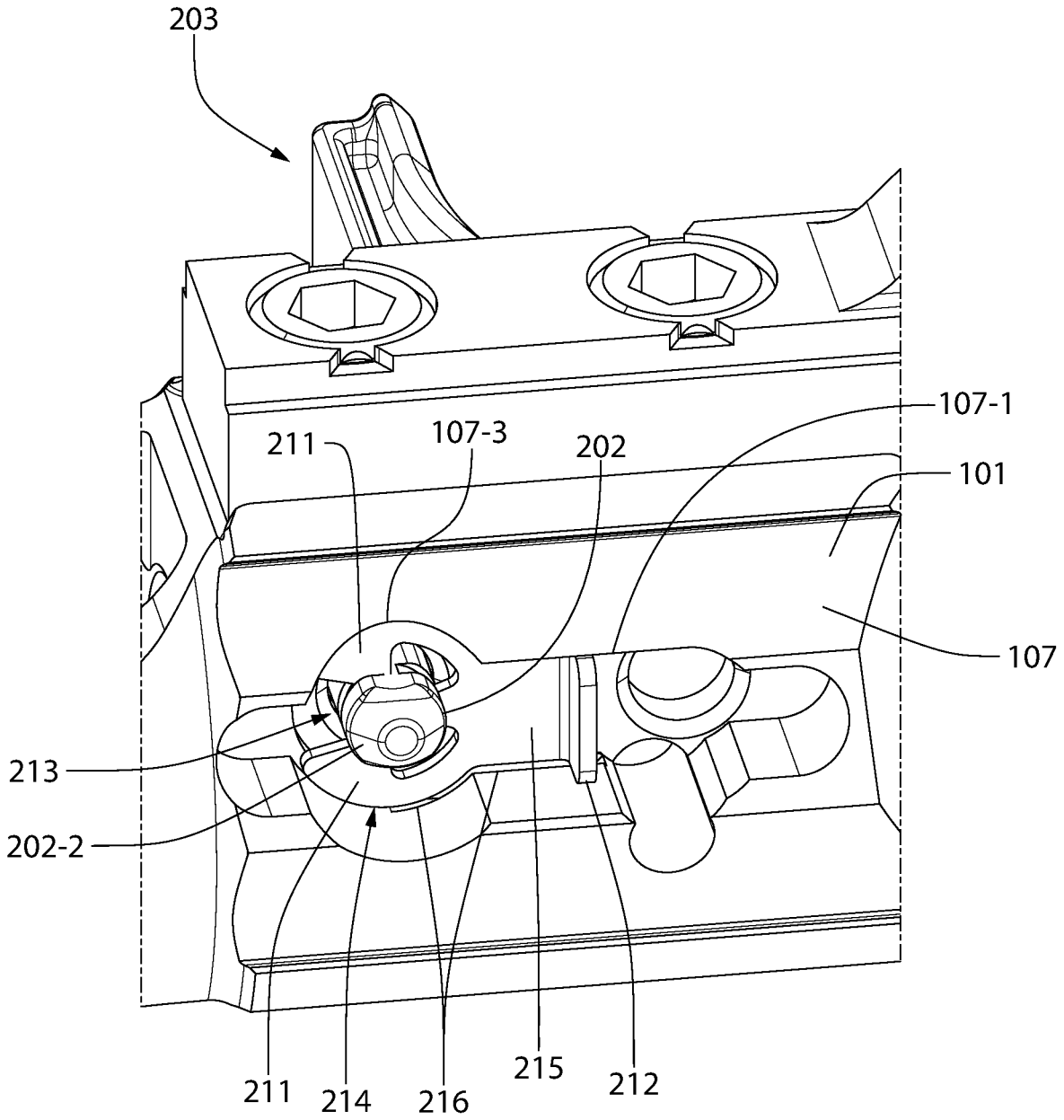
FIG. 27 is an enlarged view thereof.

Next, charging handle 200 is inserted into lateral opening 108-1 on lateral side 108 of bolt carrier 101 by concurrently inserting the mounting pin member 202 transversely/laterally through the transverse through passage 109 which extends through firing pin retention chamber 105 until the terminal end 202-2 of the mounting pin member emerges into the opposite lateral side 107 of the bolt carrier and is positioned in lateral opening 107-1 (see, e.g., FIGS. 22 and 26-27). The next step includes sliding the retention clip 210 longitudinally/axially rearward to its rearward locked position to engage the exposed portion of mounting pin member 202. Specifically, the pair of jaws 211 on the retention clip momentarily spread apart as they engage free terminal end 202-2 of the charging handle pin member 202; the clip engaging the mounting pin member in a direction perpendicular to the pin axis AX1. Jaws 211 then resiliently snap back towards each other as the mounting pin member free terminal end 202-2 of the charging handle enters the central opening 213 between the jaws with a resilient snap-lock engagement shown for example in FIGS. 26-27. The clip 210 retains the mounting pin member to prevent withdrawal in a direction transverse to longitudinal axis LA and secures the charging handle to the bolt carrier 101.

To remove the charging handle 200 from the firearm and bolt carrier assembly 100, the foregoing process is simply reversed by first manually sliding retention clip forward to its forward unlocked position to disengages jaws 211 from the charging handle mounting pin member 202. Once unlocked, the charging handle may then be transversely/laterally withdrawn from through passage 109 to completely remove the handle from the firearm and bolt carrier assembly.

Figure 12:
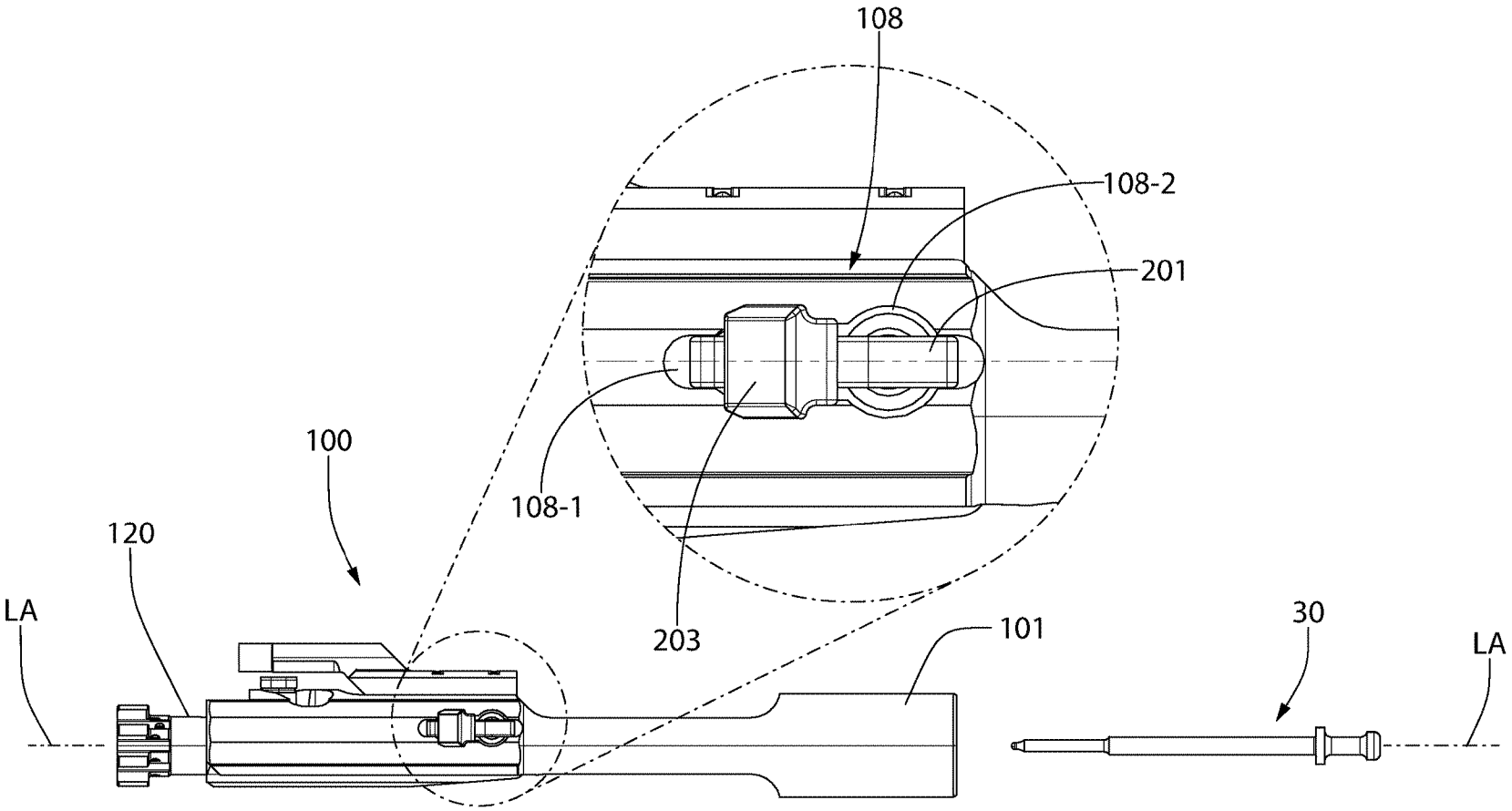
FIG. 12 is a left side view thereof.
Figure 13:
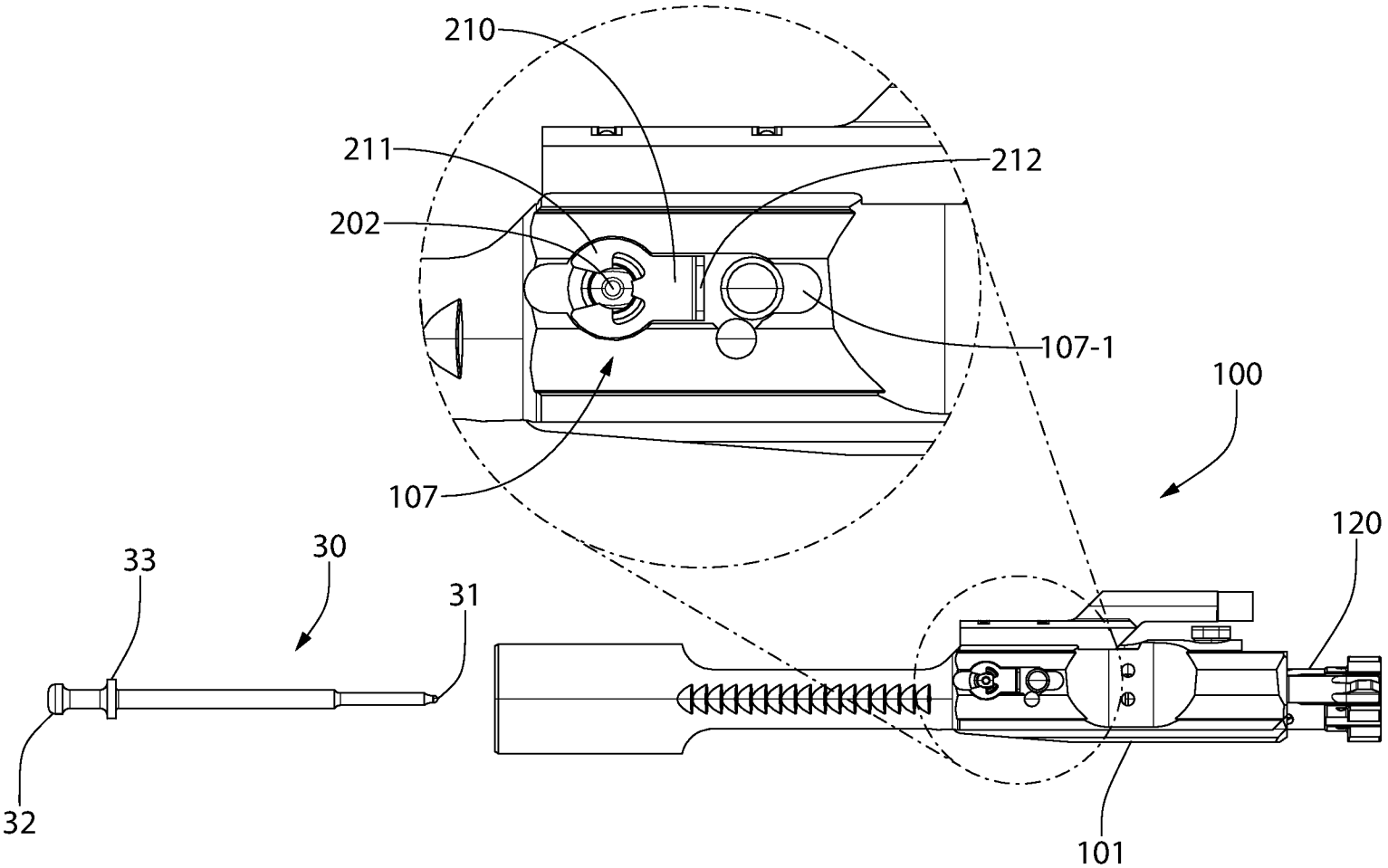
FIG. 13 is a right side view thereof.
Figure 14:
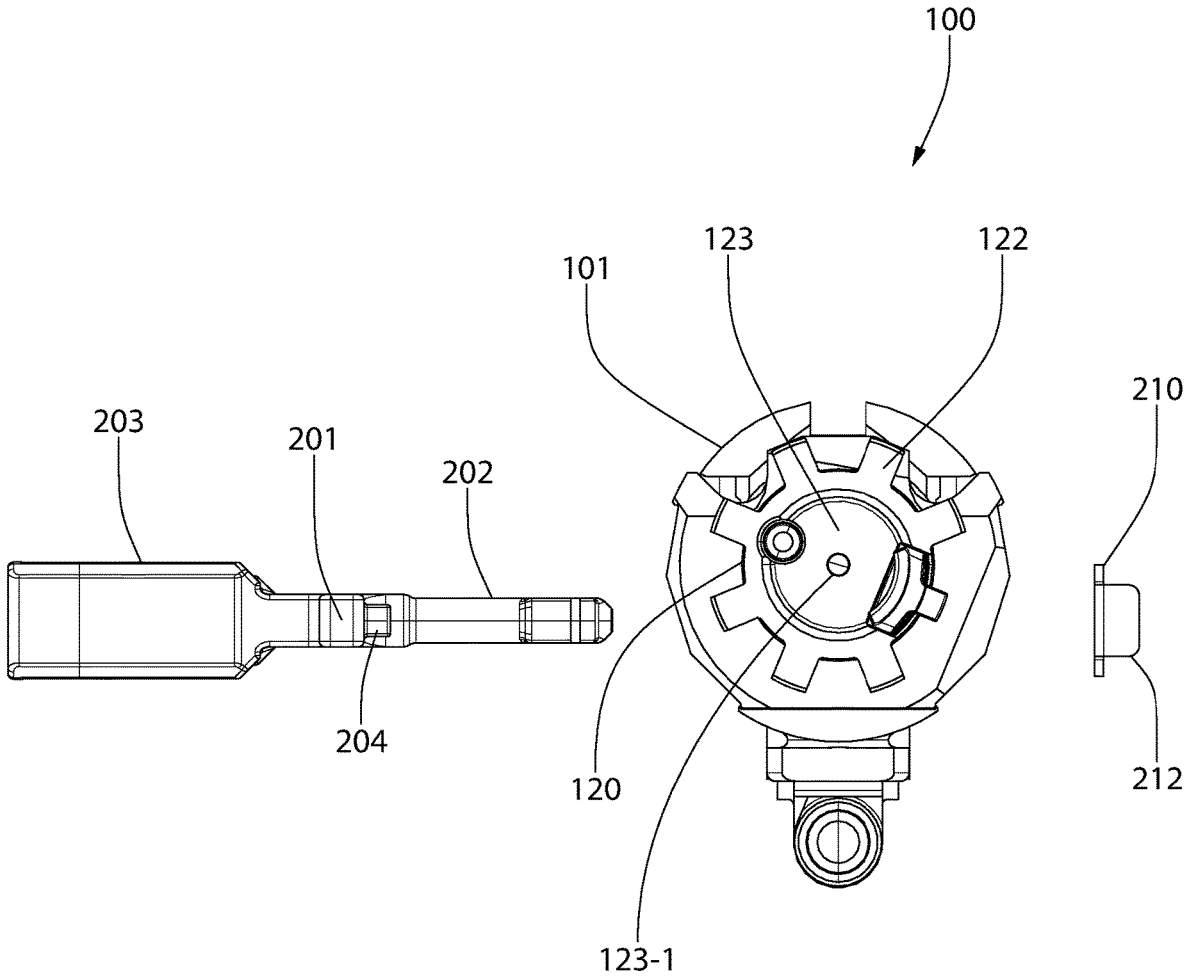
FIG. 14 is a front view thereof.
Figure 15:
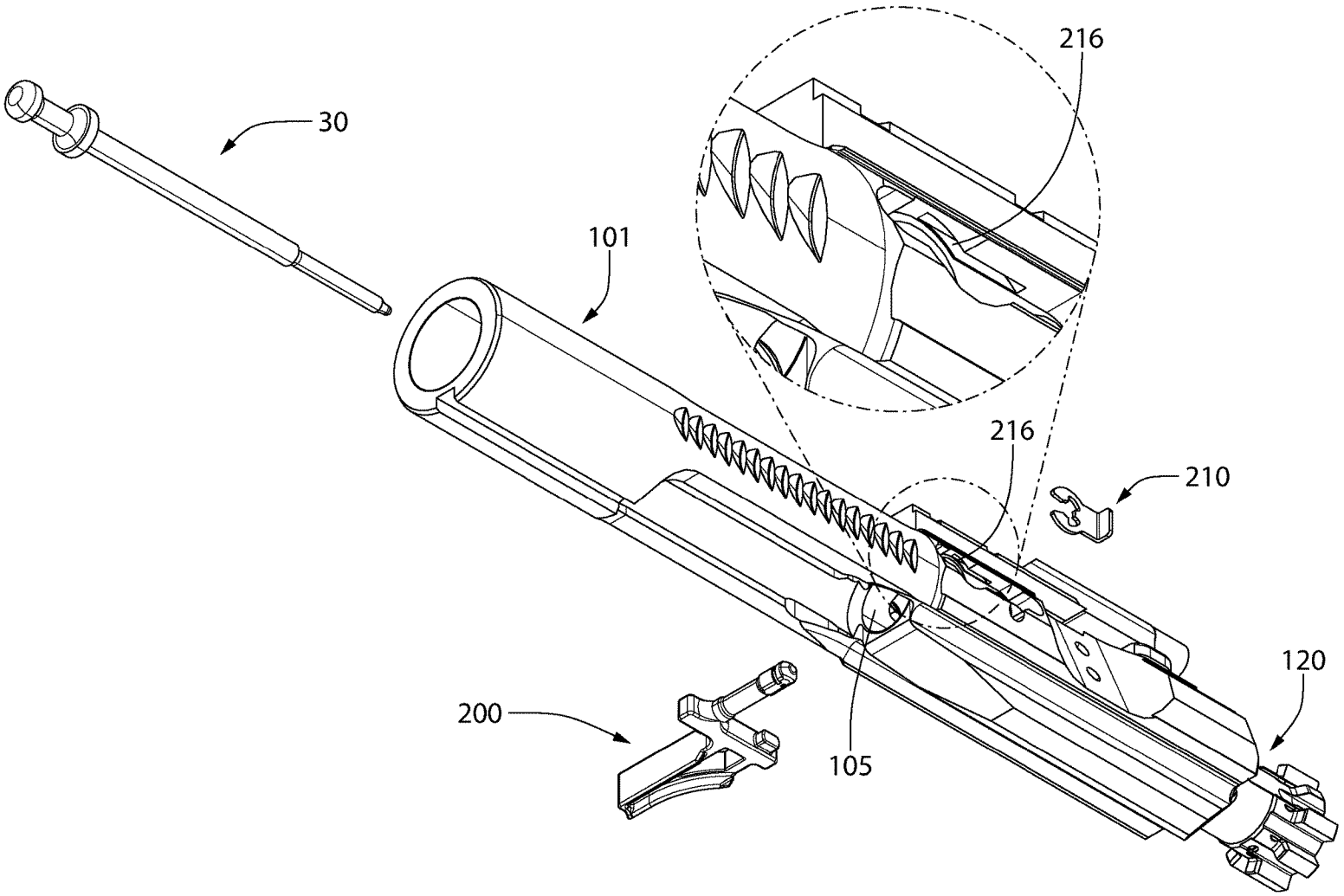
FIG. 15 is a bottom rear exploded view thereof.
Figure 16:
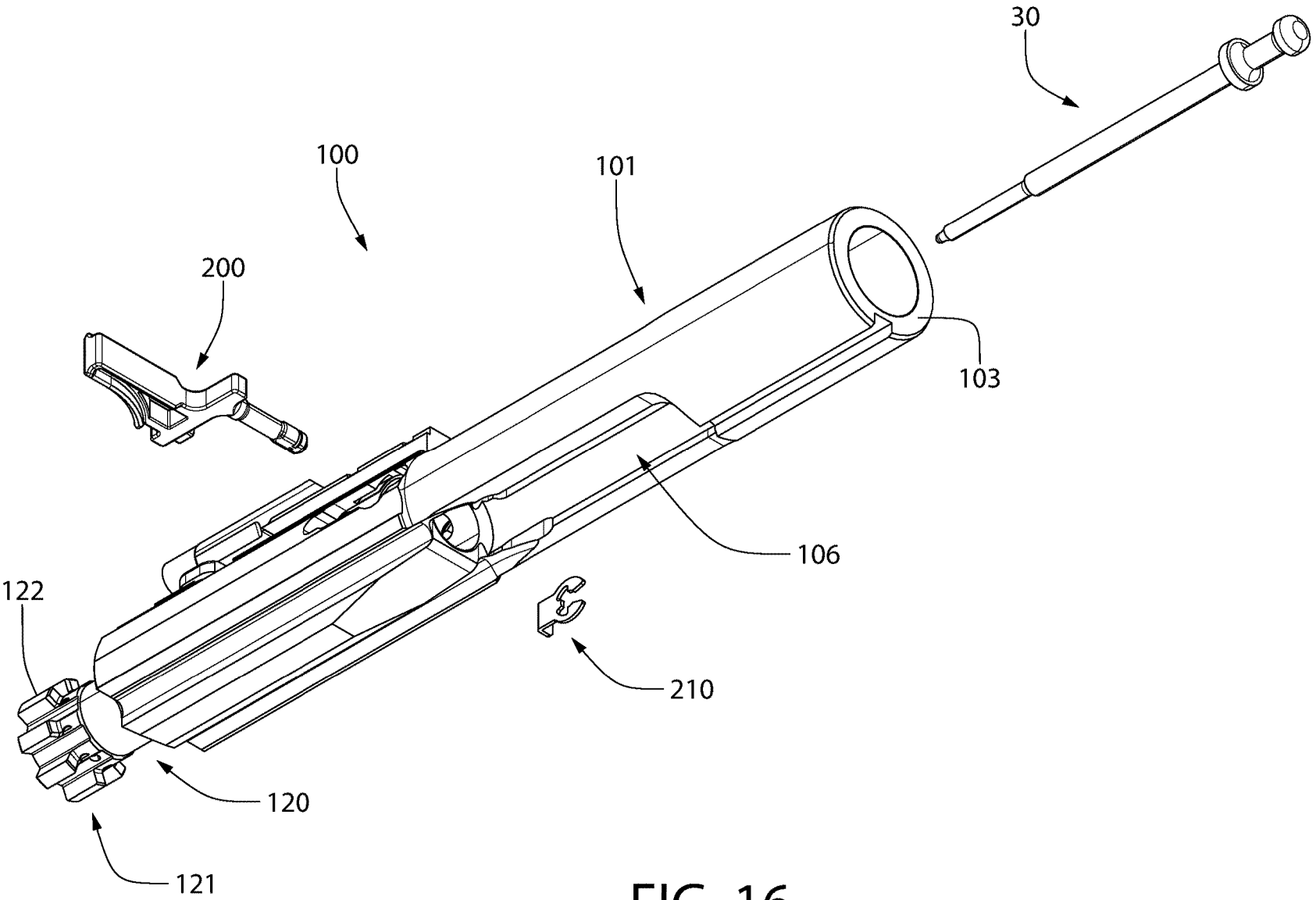
FIG. 16 is a bottom front exploded view thereof.
Figure 17:
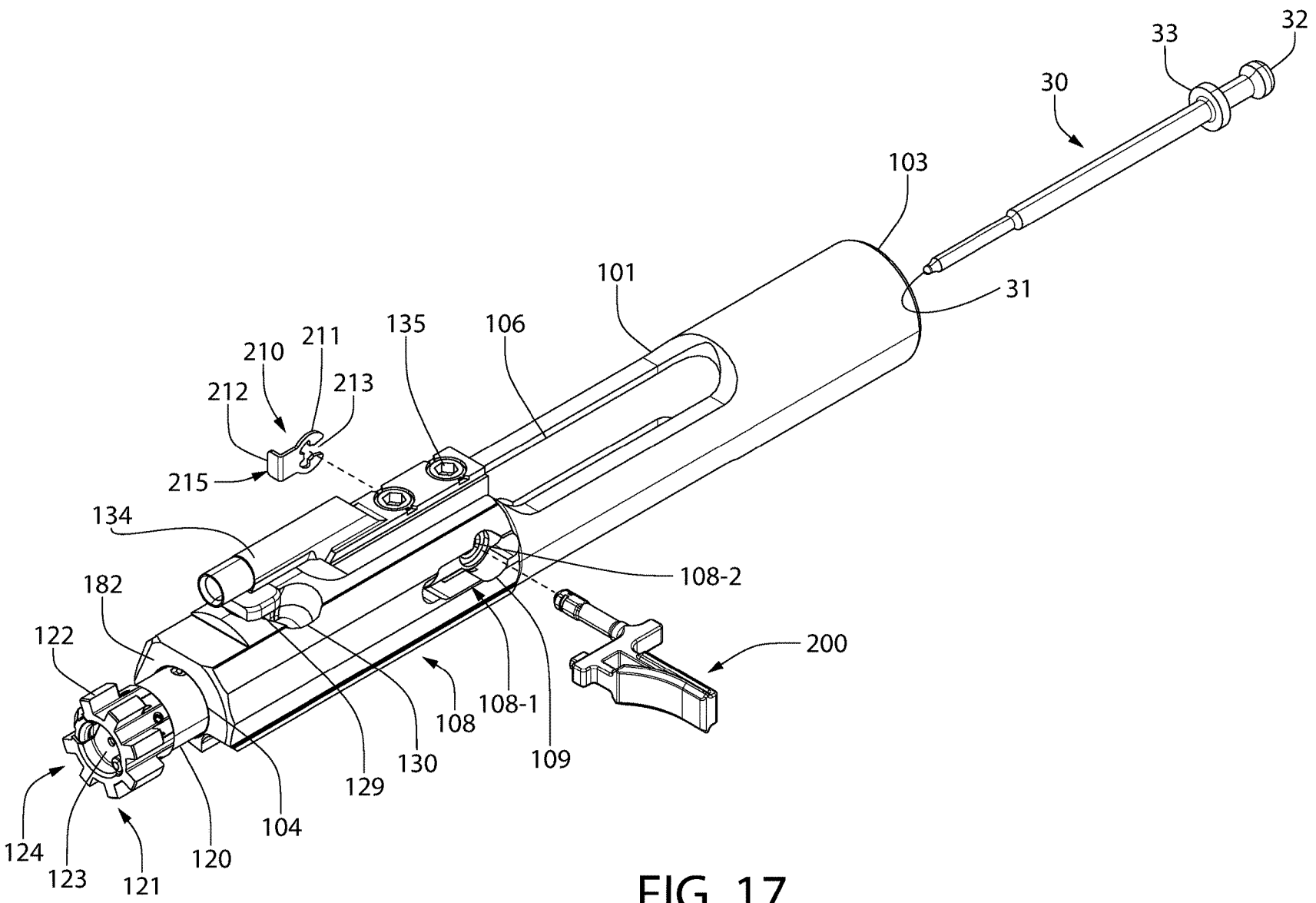
FIG. 17 is a top front left side exploded view thereof.
Figure 18:
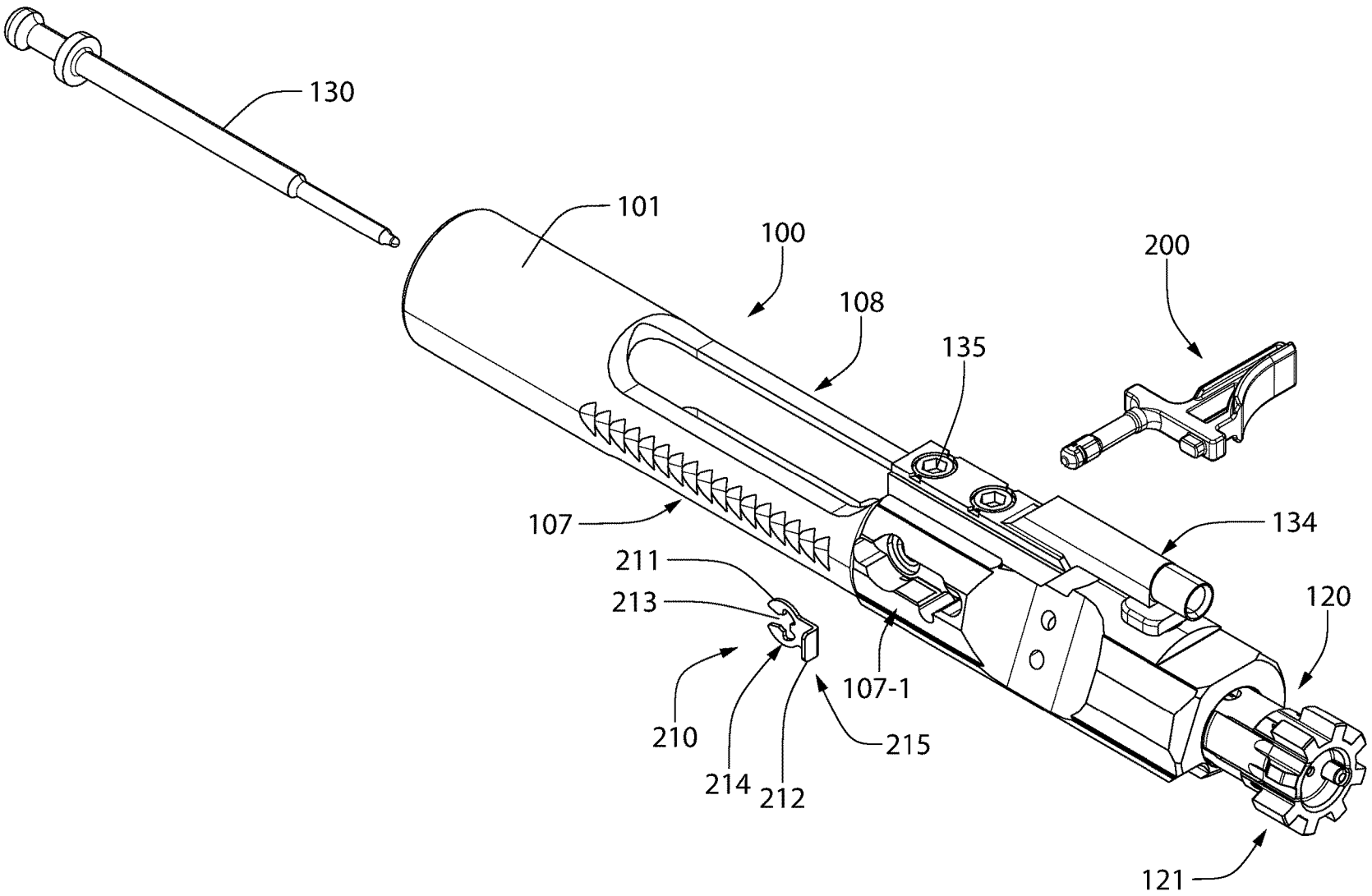
FIG. 18 is a top front right side exploded view thereof.
Figure 20:
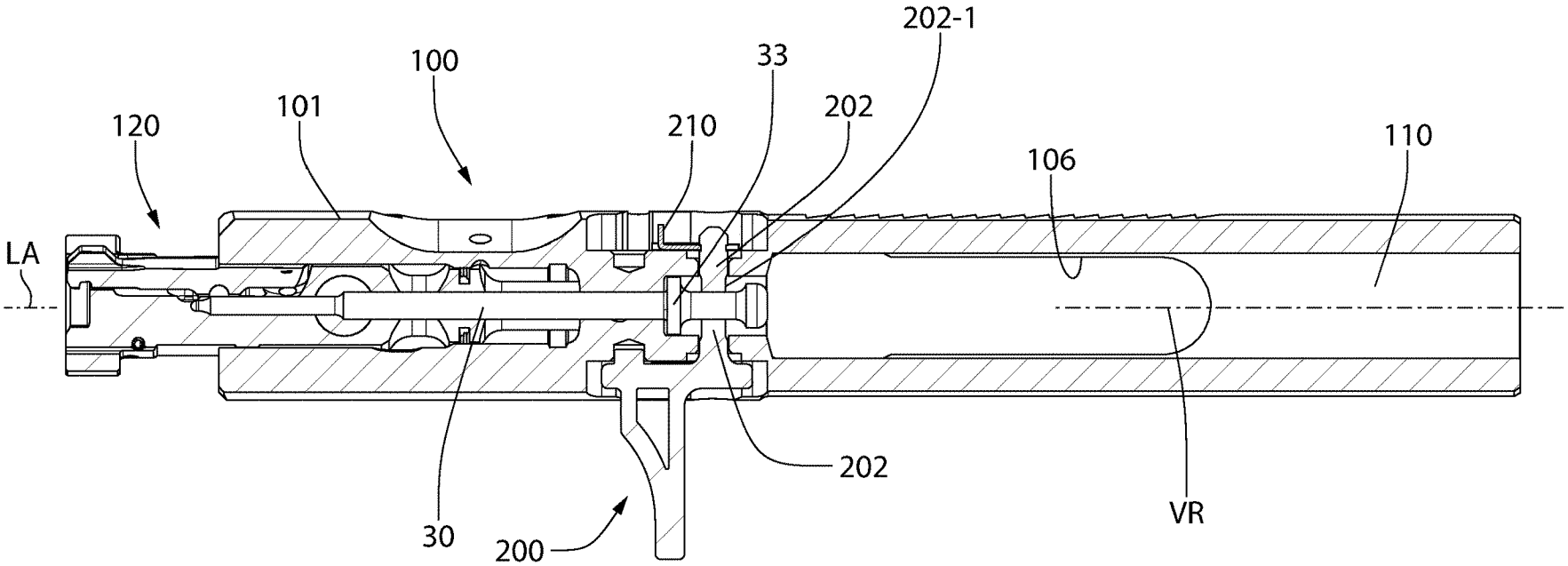
FIG. 20 is an exploded longitudinal cross sectional view thereof showing the charging handle mounted to the bolt carrier assembly.
Figure 21:
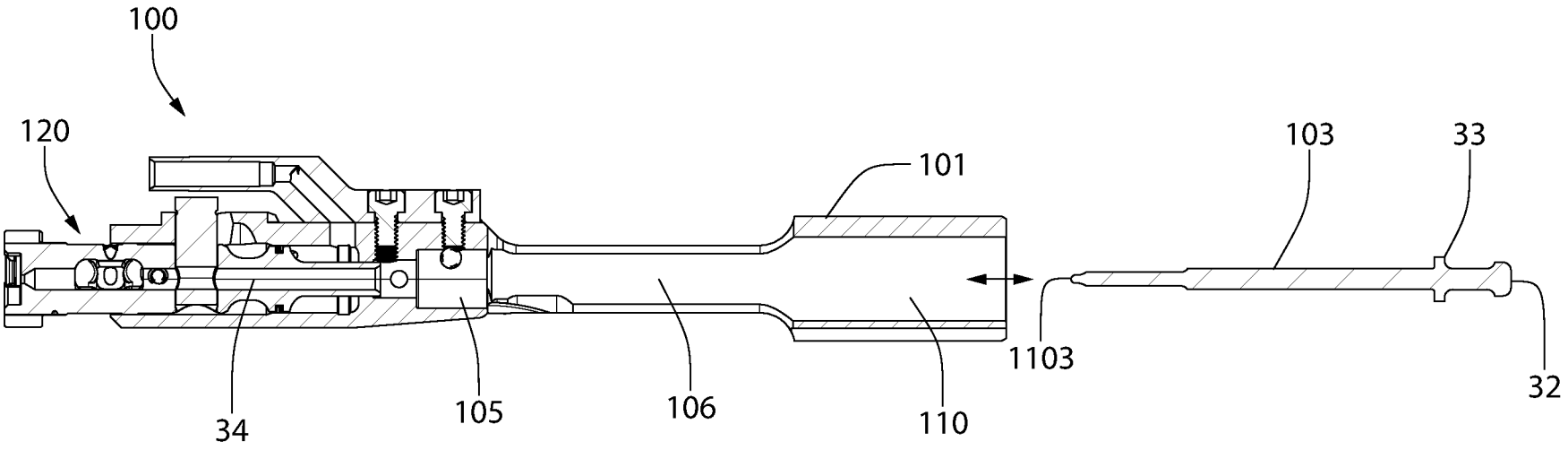
FIG. 21 is a left side cross sectional view showing the firing pin exploded out from the rear of the bolt carrier assembly.

In its fully mounted position shown for example in FIGS. 12 and 20, the longitudinal central base member 201 of charging handle 200 is at least partially nested into the longitudinally elongated lateral opening 107-1 on lateral side 107 of the bolt carrier 101. In the non-limiting illustrated embodiment, central base member 201 is completely nested and positioned inside lateral opening 107-1. The opposing ends of the central base member are engageable with the bolt carrier at the opposite ends of lateral opening 107-1 to provide additional axial support for the charging handle when it is used to manually move the bolt carrier assembly 100 rearward to open the breech.

Locating protrusion 204 projects inwardly in lateral opening 107-1 of bolt carrier 101 and is insertably engaged in an outwardly open locating socket 205 formed on the bolt carrier inside the lateral opening. The locating protrusion provides an additional point of contact with bolt carrier 101 which is forward of and in addition to the point of contact created by mounting pin member 202. The two points of contact are longitudinally/axially spaced apart to provide structural mounting stability to charging handle 200 and contributes to smooth sliding of the bolt carrier assembly 100 rearward by the user. Locating protrusion 204 further offers additional resistance against the charging handle twisting/rotating about pin axis AX1 defined by mounting pin member 202 in addition to the engagement between the longitudinal central base member 201 of the handle and parts of bolt carrier 101 located above and below the central base member within lateral opening 107-1. The foregoing features advantageously thus all cooperate to provide an extremely stable mounting interface between charging handle 200 and the bolt carrier.

Grasping member 203 projects transversely/laterally outward from the charging handle 200 (e.g., longitudinal central base member 201) and bolt carrier 101 for a distance to allow a user to grasp the handle and manually move/cycle the bolt carrier assembly 100 rearward to open the breech. To facilitate grasping the charging handle by the users fingers and/or thumb, grasping member 203 in one embodiment may include an arcuately curved gripping surface 203-1 which may face forward. Other configurations of the grasping member however may be used.

It bears repeating that the charging handle 200 is fully ambidextrous in nature and mountable to either the right or left lateral sides 107, 108 respectively of the bolt carrier 101. Accordingly, although the drawings and description show the charging handle being mounted on the left lateral side 108 of the bolt carrier assembly 100 and firearm 20, one skilled in the art will appreciate that the charging handle could be mounted on the opposite side using the same process described above. To facilitate ambidextrous mounting of the charging handle 200 to the bolt carrier, the right lateral opening 107-1 and left lateral opening 108-1 in the bolt carrier 101 may have an identical configuration and features in one non-limiting embodiment. As one example, as shown in FIG. 19, a locating socket 205 is provided for both the right and left lateral openings to receive locating protrusion 204 regardless of which side of the firearm the user chooses to mount the charging handle depending on whether the individual is right or left handed. In a similar vane, both lateral openings 107-1, 108-1 may include a pair of longitudinal guide slots 216 to allow the charging handle retention clip 210 to be slideably mounted on either side of the firearm.

While the foregoing description and drawings represent preferred or exemplary embodiments of the present invention, it will be understood that various additions, modifications and substitutions may be made therein without departing from the spirit and scope and range of equivalents of the accompanying claims. In particular, it will be clear to those skilled in the art that the present invention may be embodied in other forms, structures, arrangements, proportions, sizes, and with other elements, materials, and components, without departing from the spirit or essential characteristics thereof. In addition, numerous variations in the methods/processes as applicable described herein may be made without departing from the spirit of the invention. One skilled in the art will further appreciate that the invention may be used with many modifications of structure, arrangement, proportions, sizes, materials, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being defined by the appended claims and equivalents thereof, and not limited to the foregoing description or embodiments. Rather, the appended claims should be construed broadly, to include other variants and embodiments of the invention, which may be made by those skilled in the art without departing from the scope and range of equivalents of the invention.

What is claimed is:

1. A firearm with side-mounted charging handle comprising:

a longitudinal axis;

a receiver defining a longitudinal cavity;

a barrel coupled to the receiver, the barrel comprising a front muzzle end, a rear breech end, and an internal bore extending axially between the ends to define a projectile passageway;

a bolt carrier assembly movably disposed in the longitudinal cavity of the receiver, the bolt carrier assembly collectively comprising a bolt carrier and a bolt disposed at least partially inside a forwardly open bolt cavity in the bolt carrier;

the bolt carrier assembly being axially moveable between a forward closed breech position in battery with the barrel and a rearward open breech position;

a firing pin disposed in a firing pin passage formed longitudinally in the bolt, the firing pin axially movable between a forward striking position for contacting a chambered cartridge in the barrel and a rearward ready-to-fire position;

a charging handle detachably mounted to the bolt carrier assembly, the charging handle comprising a mounting pin member passing transversely through the bolt carrier between first and second lateral sides thereof, and a grasping member projecting transversely outwards from the first lateral side of the bolt carrier;

the charging handle operable to manually cycle the bolt carrier assembly from the forward closed breech position to the rearward open breech position via the grasping member;

wherein the mounting pin member of the charging handle is configured and positioned to retain the firing pin in the bolt carrier by blocking withdrawal of the firing pin from the bolt carrier assembly.

2. The firearm according to claim 1 wherein the mounting pin member of the charging handle is engageable with a diametrically enlarged annular retention flange on the firing pin, the mounting pin member operable to block rearward withdrawal of the firing pin from the firing pin passage of the bolt.

3. The firearm according to claim 2, wherein the firing pin has a longitudinally elongated body defining a length, and the mounting pin member of the charging handle is oriented perpendicularly to the length of the firing pin.

4. The firearm according to claim 3, wherein the retention flange of the firing pin is disposed in a transversely open firing pin retention chamber formed inside the bolt carrier rearward of the bolt, the mounting pin member of the charging handle extending transversely through the firing pin retention chamber to the rear of the retention flange of the firing pin.

5. The firearm according to claim 4, wherein at least the portion of mounting pin member of the charging handle which is engageable with the retention flange of the firing pin has a cylindrical shape.

6. The firearm according to claim 4, wherein when the mounting pin member of the charging handle is laterally withdrawn from the bolt carrier, the firing pin can be axially withdrawn rearward from the firing pin passage of the bolt.

7. The firearm according to claim 4, wherein the mounting pin member is transversely received through recessed lateral openings on first and second lateral sides of the bolt carrier which are in communication with the firing pin retention chamber to form a transverse through passage therebetween.

8. The firearm according to claim 3, wherein the firing pin further comprising a front tip projectible through a forward breech face of the bolt for striking a chambered cartridge, and a rear striking end configured for being struck by a hammer of the firearm.

9. The firearm according to claim 2, wherein the grasping member is laterally elongated and comprises a forward facing arcuately curved grip surface for engagement by a user to cycle the bolt carrier.

10. The firearm according to claim 1, further comprising a retention clip detachably engaged with a free terminal end of the mounting pin member of the charging handle which projects transversely outwards into an elongated lateral opening formed in the second lateral side of the bolt carrier.

11. The firearm according to claim 10, wherein the retention clip comprises a C-shaped locking end portion comprising a pair of spaced apart jaws structured to resiliently and lockingly engage at least one retention groove on the free terminal end of the mounting pin member of the charging handle.

12. The firearm according to claim 11, wherein the retention clip is axially movable parallel to the longitudinal axis between a locked position engaged with the mounting pin member of the charging handle to retain the charging handle on the bolt carrier, and an unlocked position disengaged from the mounting pin member to permit removal of the charging handle.

13. The firearm according to claim 12, wherein the C-shaped locking end portion slideably engages a pair of vertically spaced apart guide grooves formed in the second lateral side of the bolt carrier when the retention clip moves between the locked and unlocked positions.

14. The firearm according to claim 13, wherein the retention clip further comprises an axially elongated operating end portion including an outwardly bent operating tab configured to be grasped by a user to manually slide the retention clip between the locked and unlocked positions.

15. The firearm according to claim 1, wherein the mounting pin member of the charging handle defines a pin axis which is parallel to but offset from a handle axis defined by the grasping member of the charging handle, the first and second axis being transverse to the longitudinal axis of the firearm.

16. The firearm according to claim 15, wherein the charging handle further comprises an inwardly projecting locating protrusion received in an outwardly open locating socket formed in the first lateral side of the bolt carrier, the locating protrusion being spaced axially apart from the mounting pin member of the charging handle.

17. The firearm according to claim 1, wherein the charging handle further comprises an elongated longitudinal base member oriented parallel to the longitudinal axis, the mounting pin member and the grasping member each cantilevered from and oriented perpendicularly to the base member.

18. The firearm according to claim 17, wherein the longitudinal base member is nested at least partially inside an axially elongate lateral opening recessed into the first lateral side of the bolt carrier.

19. The firearm according to claim 1, wherein the firearm is a gas-operated AR-type semi-automatic rifle or carbine in which the receiver comprises an upper receiver in which the bolt carrier assembly is movably mounted and a lower receiver comprising a trigger mechanism coupled to the upper receiver.

20. The firearm according to claim 1, wherein the charging handle and bolt carrier are cooperatively configured to mount the charging handle on either lateral side of the bolt carrier thereby providing an ambidextrous side-mounted charging handle.

* * * * *